US007698892B2

(12) United States Patent
Komaki et al.

(10) Patent No.: US 7,698,892 B2
(45) Date of Patent: Apr. 20, 2010

(54) EXTERNAL COMBUSTION ENGINE

(75) Inventors: Katsuya Komaki, Kariya (JP); Shinichi Yatsuzuka, Nagoya (JP); Shuzo Oda, Kariya (JP); Setsuo Nakamura, Kariya (JP)

(73) Assignee: Denso Corporation, Kariya (JP)

( * ) Notice: Subject to any disclaimer, the term of this patent is extended or adjusted under 35 U.S.C. 154(b) by 442 days.

(21) Appl. No.: 11/724,651

(22) Filed: Mar. 15, 2007

(65) Prior Publication Data

US 2007/0220888 A1 Sep. 27, 2007

(30) Foreign Application Priority Data

Mar. 22, 2006 (JP) ..... 2006-078802

(51) Int. Cl.
*F02G 1/04* (2006.01)
*F01K 23/06* (2006.01)
*F02C 5/00* (2006.01)

(52) U.S. Cl. ..... 60/531; 60/508; 60/516; 60/670; 60/39.6

(58) Field of Classification Search ..... 60/516–526, 60/531, 659, 670, 671, 508, 514; 138/26, 138/30

See application file for complete search history.

(56) References Cited

U.S. PATENT DOCUMENTS 4,195,481 A * 4/1980 Gregory ..... 60/516
4,489,553 A * 12/1984 Wheatley et al. ..... 60/516
4,584,840 A * 4/1986 Baumann ..... 62/6
6,931,852 B2 * 8/2005 Yatsuzuka et al. ..... 60/670
7,415,824 B2 * 8/2008 Komaki et al. ..... 60/508
2005/0257525 A1 11/2005 Komaki et al.

FOREIGN PATENT DOCUMENTS

JP 58-57014 4/1983
JP 2004-84523 3/2004
JP 2005-330910 12/2005

* cited by examiner

*Primary Examiner*—Thomas E Denion
*Assistant Examiner*—Christopher Jetton
(74) *Attorney, Agent, or Firm*—Harness, Dickey & Pierce, PLC

(57) ABSTRACT

An external combustion engine comprises a container (11) with a working liquid (12) sealed therein in a state adapted to flow, a heater (13) for heating and vaporizing the working liquid (12) in the container (11), and a cooler (14) for cooling and liquefying the vapor of the working liquid (12) heated and vaporized by the heater (13). The displacement of the working liquid (12) caused by the vapor volume change is output as mechanical energy by being converted into the mechanical energy. A pressure regulating liquid (18) is sealed in a pressure regulating container (16) communicating with the container (11). A pressure regulating unit (19) regulates the internal pressure (Pt) of the pressure regulating container (16). A control unit (21) controls the pressure regulating unit (19) in such a manner that the internal pressure (Pt) is decreased in the case where it is higher than the saturation vapor pressure (Ps1) of the working liquid (12) at the temperature (T1) of a heated portion (11*a*) of the container for vaporizing the working liquid (12), while the internal pressure (Pt) is increased in the case where it is lower than the saturation vapor pressure (Ps1).

6 Claims, 31 Drawing Sheets

EXTERNAL COMBUSTION ENGINE

BACKGROUND OF THE INVENTION

1. Field of the Invention

This invention relates to an external combustion engine for outputting mechanical energy by converting the displacement of a working liquid caused by the volume change of the vapor thereof into the mechanical energy.

2. Description of the Related Art

One of the conventional external combustion engines disclosed by Japanese Unexamined Patent Publication No. 205-330910 is adapted so that a working liquid is sealed in a container and part of the working liquid is heated and vaporized in a heated portion while the vapor of the vaporized working liquid is liquefied by being cooled in a cooled portion, thereby outputting by converting, to mechanical energy, the displacement of the working liquid caused by the volume change of the vapor thereof.

In this conventional technique, the external combustion engine includes a pressure sensor for detecting the internal pressure of the container, a temperature sensor for detecting the temperature of the heated portion of the container for vaporizing the working liquid, a valve for discharging the working liquid from the container into the atmosphere and a control unit for controlling the on/off operation of the valve.

In the case where the internal pressure of the container exceeds the saturation vapor pressure of the working liquid at the temperature of the heated portion, part of the working liquid in the container is discharged into the atmosphere and the volume of the working liquid is reduced thereby to control the internal pressure of the container not to exceed the saturation vapor pressure of the working liquid.

As a result, the internal pressure of the container is prevented from exceeding the saturation vapor pressure of the working liquid and part of the vapor from being condensed and liquefied, thereby suppressing a reduction in the output and efficiency of the external combustion engine (see FIG. 3C as described later).

SUMMARY OF THE INVENTION

Experiments conducted by the inventor show that the output and efficiency of the external combustion engine are highest in the case where the peak value of the internal pressure of the container is lower than, and as near as possible to, the saturation vapor pressure of the working liquid (see FIG. 3B as described later).

In this conventional technique, however, the volume of the working liquid, once reduced, cannot be increased. Once the saturation vapor pressure of the working liquid increases with the temperature rise of the heated portion, however, the peak value of the internal pressure of the container is excessively reduced below the saturation vapor pressure of the working liquid, thereby leading to the problem that the output and efficiency of the external combustion engine are reduced.

Another problem of the conventional technique is that a change in the temperature of the heated portion or the cooled portion of the container for liquefying the vapor of the working liquid changes the temperature of the working liquid and, therefore, the volume of the working liquid undergoes a change due to the thermal expansion and contraction. This volume change of the working liquid reduces the output and efficiency of the external combustion engine (see FIG. 5 as described later).

In view of this situation, the object of this invention is to suppress the reduction in the performance (output and efficiency) of the external combustion engine which otherwise might be caused by the change in the peak value of the internal pressure of a container, the change in the saturation vapor pressure of the working liquid and the volume change of the working liquid.

In order to achieve the object described above, according to a first aspect of the invention, there is provided an external combustion engine comprising:

a container (11) with a working liquid (12) sealed and adapted to flow therein;

a heater (13) for heating and vaporizing the working liquid (12) in the container (11); and a cooler (14) for cooling and liquefying the vapor of the working liquid (12) heated and vaporized by the heater (13);

wherein the displacement of the working liquid (12) caused by the vapor volume change into mechanical energy, the external combustion engine further comprising:

a pressure regulating container (16) sealed with a pressure regulating liquid (18) and communicating with the container (11);

a pressure regulating means (19) for regulating the internal pressure (Pt) of the pressure regulating container (16); and a control means (21) for controlling the pressure regulating means (19) in such a manner that the internal pressure (Pt) is reduced in the case where it is higher than the saturation vapor pressure (Ps1) of the working liquid (12) at the temperature (T1) of the heated portion (11*a*) of the container for vaporizing the working liquid (12), and the internal pressure (Pt) is increased in the case where it is lower than the saturation vapor pressure (Ps1).

In this aspect, the control means (21) controls the pressure regulating means (19) in such a manner that the internal pressure (Pt) of the pressure regulating container (16) is reduced if it is higher than the saturation vapor pressure (Ps1) of the working liquid (12) at the temperature (T1) of the heated portion (11*a*), while the internal pressure (Pt) is increased if it is lower than the saturation vapor pressure (Ps1). As a result, the peak value (Pt1) of the internal pressure (Pt) of the pressure regulating container (16) can be approximated to the saturation vapor pressure (Ps1) of the working liquid (12) at the temperature (T1) of the heated portion (11*a*).

Also, in view of the fact that the container (11) communicates with the pressure regulating container (16), the internal pressure (Pc) of the container (11) can be rendered to follow the internal pressure (Pt) of the pressure regulating container (16).

Consequently, the peak value (Pc1) of the internal pressure (Pc) of the container (11) can be approximated to the saturation vapor pressure (Ps1) of the working liquid (12) at the temperature (T1) of the heated portion (11*a*). As a result, the operating condition of the external combustion engine can be kept approximate to the ideal state, and therefore the reduction in the performance (output and efficiency) of the external combustion engine can be prevented, which otherwise might be caused by the change in the saturation vapor pressure (Ps1) or the peak value (Pc1) of the internal pressure (Pc) of the container (11).

According to a second aspect of the invention, there is provided an external combustion engine comprising:

a container (11) with a working liquid (12) sealed and adapted to flow therein;

a heater (13) for heating and vaporizing the working liquid (12) in the container (11); and a cooler (14) for cooling and liquefying the vapor of the working liquid (12) heated and vaporized by the heater (13);

wherein the displacement of the working liquid (12) caused by the volume change of the vapor into mechanical energy, the external combustion engine further comprising:

a pressure regulating container (16) sealed with a pressure regulating liquid (18) and communicating with the container (11);

a restrictor means (30) disposed in the communication unit (17) between the pressure regulating container (16) and the container (11);

a pressure regulating means (19, 32, 46, 55) for regulating the internal pressure (Pt) of the pressure regulating container (16); and a control means (21) for controlling the pressure regulating means (19, 32, 46, 55) in such a manner as to reduce the internal pressure (Pt) of the pressure regulating container (16) if it is higher than a target value (Pc0) and to increase the internal pressure (Pt) if it is lower than the target value (Pc0).

In this aspect of the invention, the arrangement of the restrictor means (30) in the communication unit (17) between the pressure regulating container (16) and the container (11) prevents the internal pressure (Pt) of the pressure regulating container (16) from changing with the periodic change in the internal pressure (Pc) of the container (11), thereby making it possible to settle the internal pressure (Pt) of the pressure regulating container (16) at a level substantially equal to the average value (Pca) of the internal pressure (Pc) of the container (11).

Also, the control means (21) controls the pressure regulating means (19, 32, 46, 55) in such a manner as to reduce the internal pressure (Pt) of the pressure regulating container (16) if it is higher than a target value (Pc0) and to increase the internal pressure (Pt) of the pressure regulating container (16) if it is lower than the target value (Pc0). Therefore, the internal pressure (Pt) of the pressure regulating container (16) can be approximated to the target value (Pc0).

Then, the average value (Pca) of the internal pressure (Pc) of the container (11) follows the internal pressure (Pt) of the pressure regulating container (16), and therefore the average value (Pca) of the internal pressure (Pc) of the container (11) can be approximated to the target value (Pc0). As a result, the reduction in the performance (output and efficiency) of the external combustion engine can be prevented, which otherwise might be caused by the change in the saturation vapor pressure (Ps1) or the change in the peak value (Pc1) of the internal pressure (Pc) of the container (11).

According to a third aspect of the invention, there is provided an external combustion engine, wherein the control means (21) sets, as a target value (Pc0), the intermediate value between the saturation vapor pressure (Ps1) of the working liquid (12) at the temperature (T1) of the heated portion (11*a*) of the container for vaporizing the working liquid (12) and the saturation vapor pressure (Ps2) of the working liquid (12) at the temperature (T2) of the cooled portion (11*b*) of the container for liquefying the vapor of the working liquid (12).

As a result, the target value (Pc0) can be set as a value close to the ideal average value (Pci) (see FIG. 3(*a*) described later), and therefore the operating condition of the external combustion engine can always be approximated to the ideal state. Thus, the reduction in the performance (output and efficiency) of the external combustion engine which otherwise might be caused by the change in the saturation vapor pressure (Ps1) or the change in the peak value (Pc1) of the internal pressure (Pc) of the container (11) can be further prevented.

According to a fourth aspect of the invention, there is provided an external combustion engine, wherein the pressure regulating means can be configured of a piston mechanism (19) adapted to reciprocate in the pressure regulating container (16).

According to a fifth aspect of the invention, there is provided an external combustion engine, wherein a gas (100) is sealed, together with the pressure regulating liquid (18), in the pressure regulating container (16).

In view of the fact that the compressibility of a gas is higher than that of a liquid, as is well known, the change amount of the internal pressure (Pt) of the pressure regulating container (16) with respect to the displacement amount of the piston mechanism (19) can be suppressed more than in the case where only the pressure regulating liquid (18) is filled up in the pressure regulating container (16). As a result, the fine adjustment of the internal pressure (Pt) of the pressure regulating container (16) can be facilitated.

According to a sixth aspect of the invention, there is provided an external combustion engine, wherein the pressure regulating means can be configured of a pump mechanism (32) for sucking in the pressure regulating liquid (18) from the pressure regulating container (16) on the one hand and discharging the pressure regulating liquid (18) to the pressure regulating container (16) on the other hand.

According to a seventh aspect of the invention, there is provided an external combustion engine, wherein the pressure regulating means can be configured of a heating means (46, 55) for heating and vaporizing thee pressure regulating liquid (18).

In this case, the internal pressure (Pt) of the pressure regulating container (16) can be detected directly by a pressure sensor or the like, or the internal pressure (Pt) of the pressure regulating container (16) can be calculated based on the temperature of the heating means (46, 55) detected by a temperature sensor or the like and the vapor pressure curve of the pressure regulating liquid (18).

According to an eighth aspect of the invention, there is provided an external combustion engine, wherein the pressure regulating container (16) and the heating means (46, 55) are adapted to maintain at least a part of the pressure regulating liquid (18) in a boiling state.

In this case, the internal pressure (Pt) of the pressure regulating container (16) can be maintained at the same level as the saturation vapor pressure of the pressure regulating liquid (18), and therefore, the internal pressure (Pt) of the pressure regulating container (16) can be positively regulated to the desired level by adjusting the temperature of the pressure regulating liquid (18).

According to a ninth aspect of the invention, there is provided an external combustion engine, wherein the heating means (46) can be configured of an electric heater (46*a*) arranged on the outer surface of the pressure regulating container (16) and a temperature controller (47) for controlling the temperature of the electric heater (46*a*).

According to a tenth aspect of the invention, there is provided an external combustion engine, wherein the control means (21) calculates the internal pressure (Pt) based on at least the wattage (Q3) input to the electric heater (46*a*), the temperature of the pressure regulating container (16) yet to be heated by the electric heater (46*a*) and the vapor pressure curve of the pressure regulating liquid (18).

In this case, the internal pressure (Pt) of the pressure regulating container (16) can be calculated without using the pressure sensor or the temperature sensor. Therefore, neither must the pressure sensor be inserted into the pressure regulating container (16) nor must the temperature sensor be disposed at a part heated to high temperatures by the electric heater (46*a*).

As a result, the inconvenience of the pressure regulating liquid (18) in the pressure regulating container (16) leaking from the pressure sensor unit and the inconvenience of the temperature sensor being damaged by the high temperature of the electric heater (46) can be avoided.

According to an 11th aspect of the invention, there is provided an external combustion engine, wherein the heating means (55) can be configured of a pressure regulating heater (53) for heating the pressure regulating liquid (18) with a high-temperature gas as a heat source and a flow rate regulating means (54) for regulating the flow rate (mg) of the high-temperature gas under the control of the control means (21).

According to a 12th aspect of the invention, there is provided an external combustion engine, wherein the control means (21) may calculate the internal pressure. (Pt) based on at least the temperature (Tgi) of the high-temperature gas before heating the pressure regulating container (16), the temperature (Tgo) of the high-temperature gas after heating the pressure regulating container (16), the flow rate (mg), the temperature (T2) of the cooled portion (11*b*) of the container for liquefying the vapor of the working liquid (12) and the vapor pressure curve of the pressure regulating liquid (18).

According to a 13th aspect of the invention, there is provided an external combustion engine comprising:

a container (11) sealed with a working liquid (12) adapted to flow therein;

a heater (13) for heating and vaporizing the working liquid (12) in the container (11); and a cooler (14) for cooling and liquefying the vapor of the working liquid (12) heated and vaporized by the heater (13);

wherein the displacement of the working liquid (12) caused by the volume change of the vapor is output by being converted into the mechanical energy, the external combustion engine further comprising:

a pressure regulating container (16) sealed with a pressure regulating liquid (18) and communicating with the container (11);

a heating means (53) for heating and vaporizing the pressure regulating liquid (18); and a restrictor means (30) disposed in the communication unit (17) between the pressure regulating container (16) and the container (11);

wherein the pressure regulating container (16) and the heating means (46, 55) are adapted to maintain at least a part of the pressure regulating liquid (16) in a boiling state; and wherein the pressure regulating container (16) is adapted to have a thermal resistance with which the temperature (Th) of the high-temperature part (48) of the pressure regulating container (16) for vaporizing the pressure regulating liquid (18) assumes a value intermediate between the temperature (T1) of the heated portion (11*a*) of the container for vaporizing the working liquid (12) and the cooled portion of the container for liquefying the vapor of the working liquid (12).

In this case, as the restrictor means (30) is disposed in the communication unit (17) between the pressure regulating container (16) and the container (11), the internal pressure (Pt) of the pressure regulating container (16) can be set at a level substantially equal to the average value (Pca) of the internal pressure (Pc) of the container (11).

Also, in view of the fact that at least a part of the pressure regulating liquid (18) is maintained in a boiling state, the internal pressure (Pt) of the pressure regulating container (16) can be maintained at the same level as the saturation vapor pressure of the pressure regulating liquid (18). By controlling the temperature of the pressure regulating liquid (18), therefore, the internal pressure (Pt) of the pressure regulating container (16) can be regulated positively to the desired level.

Further, as the temperature (Th) of the high-temperature portion (48) assumes a value intermediate between the temperature (T1) of the heated portion (11*a*) and the temperature (T2) of the cooled portion (11*b*), the temperature of the pressure regulating liquid (18) can be set to a value intermediate between the temperature (T1) of the heated portion (11*a*) and the temperature (T2) of the cooled portion (11*b*).

As a result, the internal pressure (Pt) of the pressure regulating container (16) can be kept at a value intermediate the saturation vapor pressure (Ps1) of the working liquid (12) at the temperature (T1) of the heated portion (11*a*) and the saturation vapor pressure (Ps2) of the working liquid (12) at the temperature (T2) of the cooled portion (11*b*). In other words, the internal pressure (Pt) of the pressure regulating container (16) can be always approximated to the ideal average value (Pci).

Then, the average value (Pca) of the internal pressure (Pc) of the container (11) follows the internal pressure (Pt) of the pressure regulating container (16), and therefore, the average value (Pca) of the internal pressure (Pc) of the container (11) can be always approximated to the ideal average value (Pci).

As a result, the operating condition of the external combustion engine can always be approximated to the ideal state with a simple structure. Therefore, while suppressing the cost increase, the reduction in the performance (output and efficiency) of the external combustion engine which otherwise might be caused by the change in the saturation vapor pressure (Ps1) or the change in the peak value (Pc1) of the internal pressure (Pc) of the container (11) can be prevented.

According to a 14th aspect of the invention, there is provided an external combustion engine, wherein the heat source of the heating means (53) may be a high-temperature gas.

According to a 15th aspect of the invention, there is provided an external combustion engine, wherein the energy efficiency can be improved by using the high-temperature gas as another heat source of the heated portion (11*a*) of the container for vaporizing the working liquid (12).

According to a 16th aspect of the invention, there is provided an external combustion engine, wherein the energy efficiency can be improved more by arranging the heating means (56) downstream of the heated portion (11*a*) in the high-temperature gas flow.

According to a 17th aspect of the invention, there is provided an external combustion engine, further comprising a heat conduction means (61) for conducting the heat of the heated portion (11*a*) to the heating means (56).

According to an 18th aspect of the invention, there is provided an external combustion engine, wherein the pressure regulating container (16) includes a volume regulating mechanism (70, 72, 73) for increasing the volume of the pressure regulating container (16) upon vaporization of the pressure regulating liquid (18).

In this case, the expansion of the volume of the vapor (50) of the vaporized pressure regulating liquid (18) increases the volume of the pressure regulating container (16) and therefore can absorb the volume expansion of the vapor (50). As a result, the space required for vaporizing the pressure regulating liquid (18) can be secured in the pressure regulating container (16), and therefore the vaporization of the pressure regulating liquid (18) is not prevented by the volume expansion of the vapor (50).

Further, the absorption of the volume expansion of the vapor (50) can suppress the inflow/outflow of the pressure regulating liquid (18) or the working liquid (12) between the pressure regulating container (16) and the container (11). As a result, an excessive change of the internal pressure (Pt) of the pressure regulating container (16) which otherwise might be caused by the inflow/outflow of the pressure regulating liquid (18) can be suppressed, thereby making it possible to prevent the operation of the external combustion engine from being instabilized by a great change in the internal pressure (Pt) of the pressure regulating container (16).

According to a 19th aspect of the invention, there is provided an external combustion engine, wherein the volume regulating mechanism can be configured of a mass-like elastic member (70) arranged in the pressure regulating container (16) and adapted to be compressed and reduced in volume upon vaporization of the pressure regulating liquid (18).

According to a 20th aspect of the invention, there is provided an external combustion engine, wherein a partitioning plate (72*a*) for separating the internal space of the pressure regulating container (16) into a first space sealed with the pressure regulating liquid (18) and a second space sealed with a gas (72*b*) is slidably disposed in the pressure regulating container (16), so that the vaporization of the pressure regulating liquid (18) presses the partitioning plate (72*a*) toward the second space and compresses the gas (72*b*), and the volume regulating mechanism (72) can be configured of the partitioning plate (72*a*) and the gas (72*b*).

According to a 21st aspect of the invention, there is provided an external combustion engine, wherein a partitioning plate (72*a*) for separating the internal space of the pressure regulating container (16) into a first space sealed with the pressure regulating liquid (18) and a second space provided with an elastic member (74) is slidably disposed in the pressure regulating container (16), so that the vaporization of the pressure regulating liquid (18) presses the partitioning plate (72*a*) toward the second space and compresses the elastic member (74), and the volume regulating mechanism (73) can be configured of the partitioning plate (72*a*) and the elastic member (74).

According to a 22nd aspect of the invention, there is provided an external combustion engine, wherein the pressure regulating container (16) includes a temperature regulating mechanism (75) for reducing the temperature of the pressure regulating liquid (18) upon vaporization of the pressure regulating liquid (18).

In this case, the volume expansion of the vapor (50) of the pressure regulating liquid (18) upon vaporization thereof reduces the temperature of the pressure regulating liquid (18) and causes the thermal contraction of the pressure regulating liquid (18). As a result, the volume expansion of the vapor (50) can be absorbed.

According to a 23rd aspect of the invention, there is provided an external combustion engine comprising:

a container (11) sealed with a working liquid (12) adapted to flow;

a heater (13) for heating and vaporizing the working liquid (12) in the container (11); and a cooler (14) for cooling and liquefying the vapor of the working liquid (12) heated and vaporized by the heater (13);

wherein the displacement of the working liquid (12) caused by the volume change of the vapor is output by being converted into the mechanical energy; the external combustion engine further comprising:

a plurality of pressure regulating containers (37, 38) sealed with the pressure regulating liquid (18) and communication with the container (11);

pressure means (41, 42) for applying different pressures to the interior of the plurality of the pressure regulating containers (37, 38), respectively;

a plurality of on/off valves (43, 44) for opening/closing the communication unit (39, 40) between the plurality of the pressure regulating containers (37, 38) and the container (11); and a control means (21) for controlling the plurality of the on/off valves (43, 44) in such a manner that, in the case where the average value (Pca) of the internal pressure (Pc) of the container (11) is lower than a target value (Pc0), only the communication unit of the pressure regulating container, among the plurality of the pressure regulating containers (37, 38), which has the internal pressure (Pt) higher than and nearest to the target value (Pc0) is opened, while in the case where the average value (Pca) is higher than the target value (Pc0), on the other hand, only the communication unit of the pressure regulating container, among the plurality of the pressure regulating containers (37, 38), which has the internal pressure (Pt) lower than and nearest to the target value (Pc0) is opened.

As a result, the average value (Pca) of the internal pressure (Pc) of the container (11) can be approximated to the target value (Pc0), and therefore the reduction in the performance (output and efficiency) of the external combustion engine which otherwise might be caused by the change in the saturation vapor pressure (Ps1) or the change in the peak value (Pc1) of the internal pressure (Pc) of the container (11) can be prevented.

According to a 24th aspect of the invention, there is provided an external combustion engine, wherein the pressure regulating liquid (18) may be the same as the working liquid (12).

According to a 25th aspect of the invention, there is provided an external combustion engine comprising:

a container (11) sealed with a working liquid (12) adapted to flow;

a heater (13) for heating and vaporizing the working liquid (12) in the container (11); and a cooler (14) for cooling and liquefying the vapor of the working liquid (12) heated and vaporized by the heater (13);

wherein the displacement of the working liquid (12) caused by the vapor volume change is converted into the mechanical energy; the external combustion engine further comprising:

an expansion and contraction portion (78) formed on the container (11) and capable of increasing and decreasing the volume thereof by extension and contraction;

an extension and contraction drive mechanism (79) for expanding and contracting the expansion and contraction portion (78); and a control means (21) for controlling the extension and contraction mechanism (79) in such a manner as to extend the expansion and contraction portion (78) in the case where the average value (Pca) of the internal pressure (Pc) of the container (11) is larger than a target value (Pc0) and contract the expansion and contraction portion (78) in the case where the average value (Pca) is smaller than the target value (Pc0).

In this case, the expansion and contraction portion (78) is contracted and therefore the internal pressure (Pc) of the container (11) rises in the case where the average value (Pca) of the internal pressure (Pc) of the container (11) is larger than the target value (Pc0). In the case where the average value (Pca) is smaller than the target value (Pc0), on the other hand, the expansion and contraction portion (78) extends and therefore the internal pressure (Pc) of the container (11) decreases.

As a result, the average value (Pca) of the internal pressure (Pc) of the container (11) can be approximated to the target value (Pc0) and, therefore, the reduction in the performance (output and efficiency) of the external combustion engine which otherwise might be caused by the change in the saturation vapor pressure (Ps1) or the change in the peak value (Pc1) of the internal pressure (Pc) of the container (11) can be prevented.

According to a 26th aspect of the invention, there is provided an external combustion engine comprising:

a container (11) sealed with a working liquid (12) adapted to flow;

a heater (13) for heating and vaporizing the working liquid (12) in the container (11); and a cooler (14) for cooling and liquefying the vapor of the working liquid (12) heated and vaporized by the heater (13);

wherein the displacement of the working liquid (12) caused by the vapor volume change is output by being converted into the mechanical energy; the external combustion engine further comprising:

a temperature control means (80) for controlling the temperature of the working liquid (12); and a control means (21) for controlling the temperature control means (80) in such a manner that in the case where the internal pressure (Pc) of the container (11) is higher than the saturation vapor pressure (Ps1) of the working liquid (12) at the temperature (T1) of the heated portion (11*a*) of the container for vaporizing the working liquid (12), the temperature of the working liquid (12) is decreased, while in the case where the internal pressure (Pc) is lower than the saturation vapor pressure (Ps1), the temperature of the working liquid (12) is increased.

In the case where the peak value (Pc1) of the internal pressure (Pc) of the container (11) is higher than the saturation vapor pressure (Ps1) of the working liquid (12) at the temperature (T1) of the heated portion (11*a*), the temperature of the working liquid (12) decreases, and therefore the internal pressure (Pc) of the container (11) is decreased by the thermal contraction of the working liquid (12). As a result, the peak value (Pc1) of the internal pressure (Pc) of the container (11) also decreases.

In the case where the peak value (Pc1) is lower than the saturation vapor pressure (Ps1), on the other hand, the temperature of the working liquid (12) increases and therefore the internal pressure (Pc) of the container (11) decreases. As a result, the working liquid (12) thermally expands and the internal pressure (Pc) of the container (11) increases. Thus, the peak value (Pc1) of the internal pressure (Pc) of the container (11) also increases.

As a result, the peak value (Pc1) of the internal pressure (Pc) of the container (11) can be approximated to the saturation vapor pressure (Ps1) of the working liquid (12) at the temperature (T1) of the heated portion (11*a*) and, therefore, the reduction in the performance (output and efficiency) of the external combustion engine which otherwise might be caused by the change in the saturation vapor pressure (Ps1) or the change in the peak value (Pc1) of the internal pressure (Pc) of the container (11) can be prevented.

According to a 27th aspect of this invention, there is provided an external combustion engine comprising:

a container (11) sealed with a working liquid (12) adapted to flow;

a heater (13) for heating and vaporizing the working liquid (12) in the container (11); and a cooler (14) for cooling and liquefying the vapor of the working liquid (12) heated and vaporized by the heater (13);

wherein the displacement of the working liquid (12) caused by the vapor volume change is output by being converted into the mechanical energy; the external combustion engine further comprising:

a volume regulating mechanism (85) for increasing the volume of the container (11) with the increase in the temperature (T2) of the cooled portion (11*b*) of the container for liquefying the vapor of the working liquid (12) and decreasing the volume thereof with the decrease in the temperature (T2) of the cooled portion (11*b*).

In this case, with the increase in the temperature (T2) of the cooled portion (11*b*), the temperature of the working liquid (12) increases and so does the volume of the working liquid (12) by thermal expansion. The volume of the container (11) as a whole, however, is increased by the volume regulating mechanism (85).

With the decrease in the temperature (T2) of the cooled portion (11*b*), on the other hand, the temperature of the working liquid (12) decreases and so does the volume of the working liquid (12) by thermal contraction. Nevertheless, the volume of the container (11) as a whole is decreased by the volume regulating mechanism (85).

As a result, the optimum relation can be maintained between the volume of-the working liquid (12) and the volume of the container (11), and therefore the reduction in the performance (output and efficiency) of the external combustion engine which otherwise might be caused by the volume change of the working liquid (12) is suppressed.

According to a 28th aspect of the invention, there is provided an external combustion engine comprising:

a first partitioning plate (86) adapted to slide in the container (11) for separating the internal space of the container (11) into a first space (92) sealed with a working liquid (12) and a second space (93) sealed with a first gas (89);

a second partitioning plate (87) disposed in opposed relation to the first partitioning plate (86) and adapted to slide in the container (11) for separating the internal space of the container (11) into a first space (92) and a third space (94) sealed with a second gas (90);

a connector (88) for connecting the first partitioning plate (86) and the second partitioning plate (87); and a heat conduction member (91) for thermally connecting the first gas (89) and the cooled portion (11*b*);

wherein the volume of the first space (92) is increased by the slide of the first partitioning plate (86) and the second partitioning plate (87) toward the third space (94) while the volume of the first space (92) is decreased by the slide of the first partitioning plate (86) and the second partitioning plate (87) toward the second space (93); and wherein the volume regulating mechanism (85) is configured of the first partitioning plate (86), the second partitioning plate (87), the connector (88), the first gas (89), the second gas (90) and the heat conduction member (91).

In this case, the volume regulating mechanism (85) is simplified, and therefore the cost increase is suppressed while at the same time suppressing the reduction in the performance (output and efficiency) of the external combustion engine which otherwise might be caused by the volume change of the working liquid (12).

According to a 29th aspect of the invention, there is provided an external combustion engine, wherein the volume regulating mechanism (85) is adapted so that the force (F3) exerted on the second partitioning plate (87) from the second gas (90) is larger than the maximum value (Fmax) of the force exerted on the second partitioning plate (87) from the working liquid (12).

In this case, the self-vibration of the working liquid (12) which otherwise might be hampered by the motion of the first partitioning plate (86) and the second partitioning plate (87) due to the periodic change in the internal pressure (Pc) of the container (11) is avoided.

According to a 30th aspect of the invention, there is provided an external combustion engine comprising:

a container (11) sealed with, and in a state adapted to flow, a first working liquid (96) and a second working liquid (97) smaller in the coefficient of linear expansion than, and insoluble in, the first working liquid (96);

a heater (13) for heating and vaporizing the second working liquid (97) in the container (11); and a cooler (14) for cooling and liquefying the vapor of the second working liquid (97) heated and vaporized by the heater (13);

wherein the displacement of the first working liquid (96) caused by the vapor volume change is output by being converted into the mechanical energy.

In this case, unlike in the case where only the first working liquid (96) is sealed in the container (11), the volume change of the working liquid which otherwise might be caused by the change in the temperature (T2) of the cooled portion (11*b*) can be suppressed (see FIG. 38 described later).

Without changing the structure of the external combustion engine, therefore, the volume change of the working liquid due to the temperature change of the working liquid can be suppressed. Thus, the reduction in the performance (output and efficiency) of the external combustion engine which otherwise might be caused by the volume change of the working liquid is suppressed while at the same time suppressing the cost increase.

According to a 31st aspect of the invention, there is provided an external combustion engine, wherein the gas (100) is sealed, together with the pressure regulating liquid (18), in the pressure regulating container (16, 37, 38).

The reference numerals inserted in the parentheses designating each means described above indicates the correspondence with the specific means, respectively, described in the embodiments below.

The present invention may be more fully understood from the description of preferred embodiments of the invention, as set forth below, together with the accompanying drawings.

DESCRIPTION OF THE PREFERRED EMBODIMENTS

First Embodiment

Figure 1:
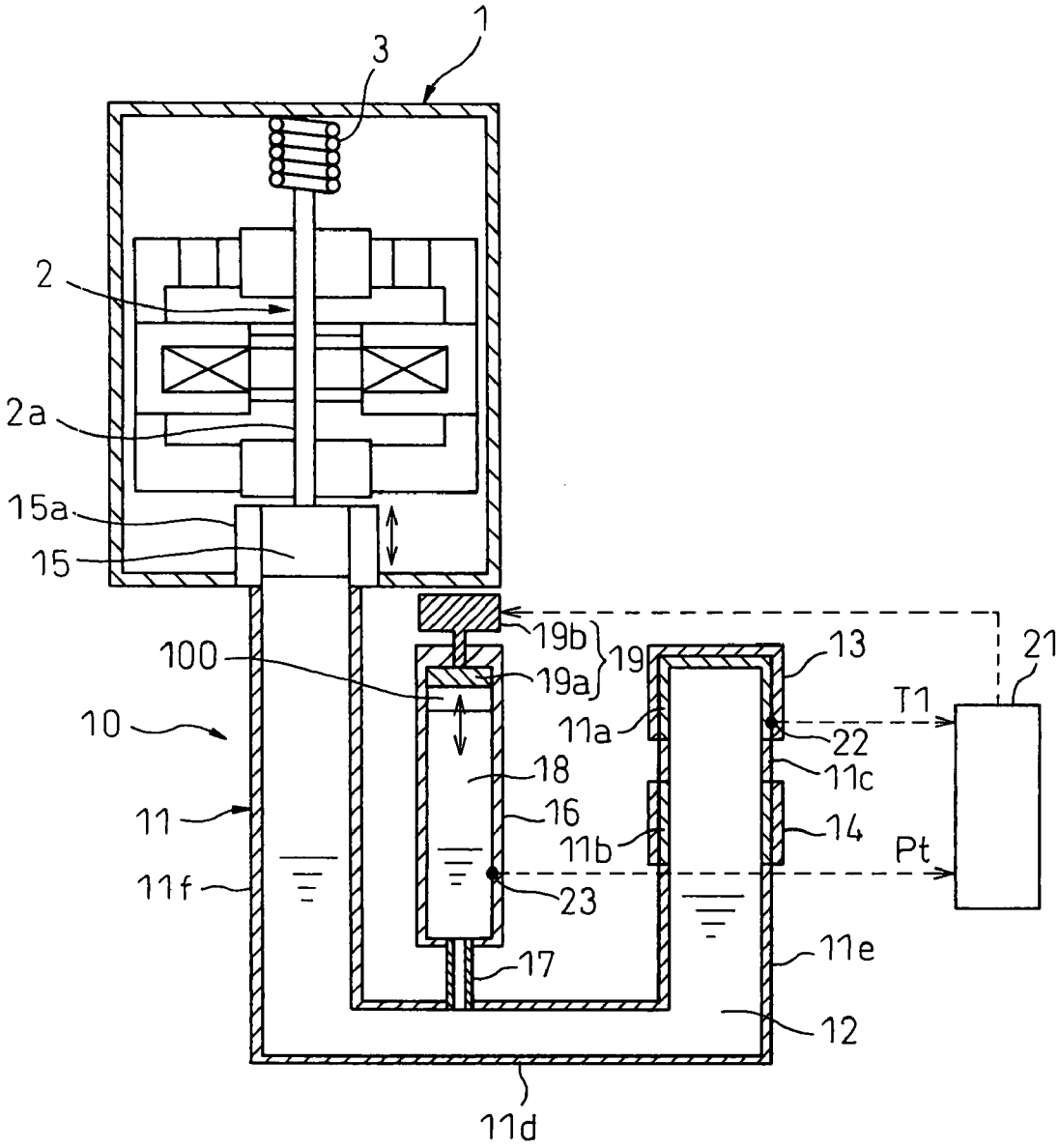
FIG. 1 is a diagram schematically showing a configuration of a power generating system according to a first embodiment of the invention.
Figure 2:
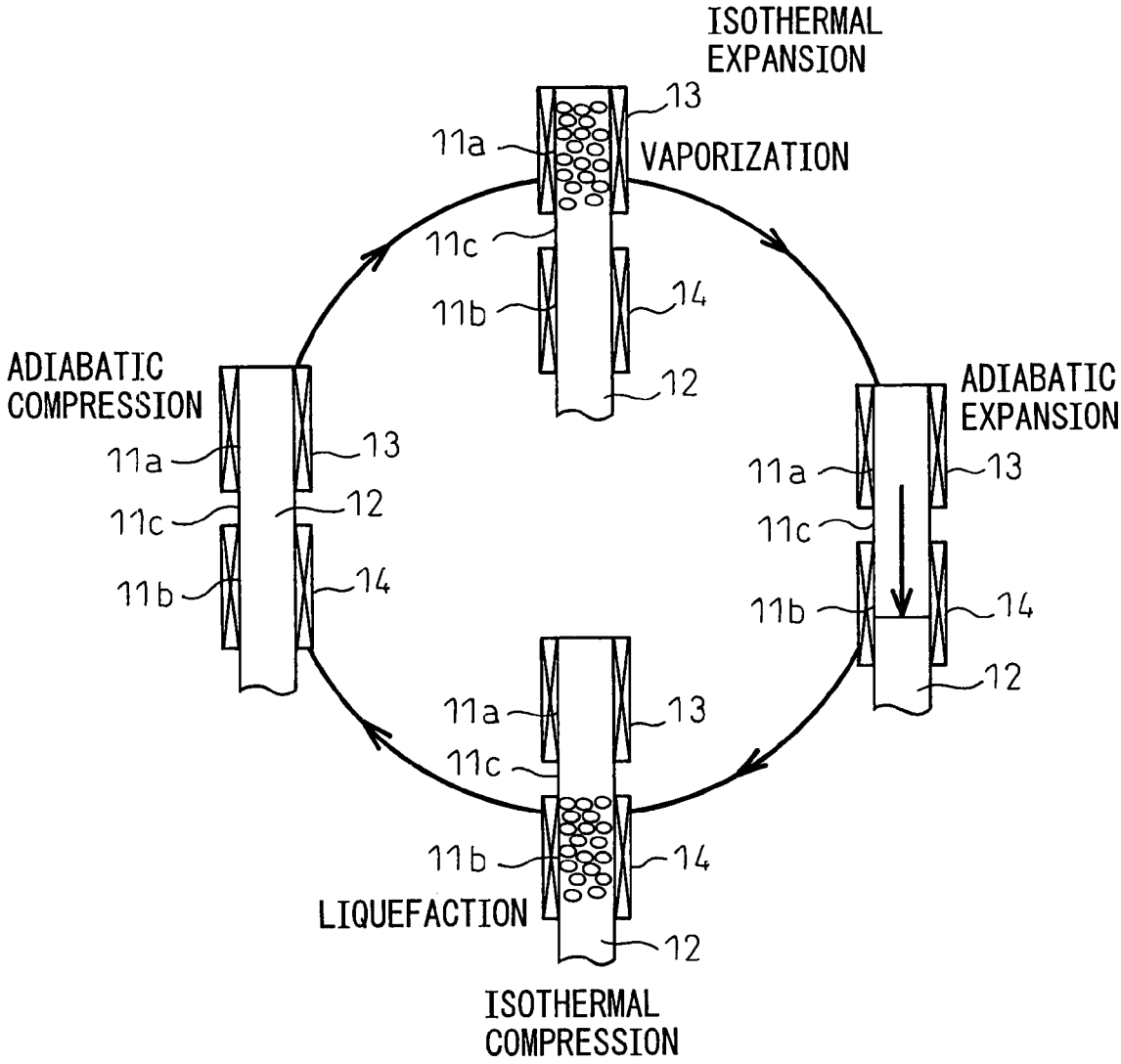
FIG. 2 is a diagram for explaining the operation characteristics of an external combustion engine according to the first embodiment.

A first embodiment of the invention is explained below with reference to FIGS. 1 to 7. FIG. 1 is a diagram showing a general configuration of a power generating system including an external combustion engine 10 according to the invention and a power generator 1.

As shown in FIG. 1, the external combustion engine 10 according to this embodiment includes a movable element 2 with a permanent magnet embedded therein, which movable element 2 is displaced by vibration thereby to drive the power generator 1 for generating electromotive force. The external combustion engine 10 comprises a container 11 sealed with a working liquid (water in this embodiment) in a state adapted to flow, a heater 13 for heating and vaporizing the working liquid 12 in the container 11 and a cooler 14 for cooling the vapor of the working liquid 12 heated and vaporized by the heater 13.

The heater 13 according to this embodiment, which is for exchanging heat with a high-temperature gas (exhaust gas of an automotive vehicle, for example), may be configured of an electric heater. The cooling water is circulated in the cooler 14 according to this embodiment. Though not shown, a radiator for radiating the heat received by the cooling water from the vapor of the working liquid 12 is arranged in the cooling water circulation circuit.

The heated portion 11*a* of the container 11 which is in contact with the heater 13 and the cooled portion 11*b* of the container 11 which is in contact with the cooler 14 are preferably formed of a material high in heat conductivity. According to this embodiment, the heated portion 11*a* and the cooled portion 11*b* are formed of copper or aluminum.

The intermediate portion 11*c* between the heated portion 11*a* and the cooled portion 11*b* of the container 11, on the other hand, is formed of stainless steel high in heat insulation ability. The portion of the container 11 nearer to the power generator 1 than the cooled portion 11*b* is also formed of stainless steel high in heat insulation ability.

The container 11 is a pipe-shaped pressure vessel substantially in the shape of U having first and second linear portions 11*e*, 11*f* with a bent portion 11*d* located at the lowest position. The heater 13 and the cooler 14 are arranged with the former located above the latter in the first linear portion 11*e* which is located at a horizontal end (right side on the page) of the container 11 beyond the bent portion 11*d*.

Though not shown, a gas having a predetermined volume is sealed at the upper end of the first linear portion 11*e* to secure the space for vaporizing the working liquid 12. This gas may be either air or a pure vapor of the working liquid 12.

A piston 15 adapted to be displaced under the pressure from the working liquid is slidably disposed in a cylinder portion 15*a* at the upper end of the second linear portion 11*f* of container 11 formed at the other horizontal end (left side on the page) beyond the bent portion 11*d* of the container 11.

The piston 15 is connected to the shaft 2*a* of the movable element 2, and a spring 3 making up an elastic means for generating the elasticity to press the movable element 2 against the piston 15 is disposed on the other side of the movable element 2 far from the piston 15.

The bent portion 11*d* of the container 11 communicates, through a connecting pipe 17, with a pressure regulating container 16 for regulating the internal pressure of the container 11 (hereinafter sometimes referred to as the in-container pressure). The connecting pipe 17 corresponds to the communication unit according to the invention.

The pressure regulating container 16 is filled up with a pressure regulating liquid 18 and a gas 100. According to this embodiment, the pressure regulating container 16 is disposed above the bent portion 11*d*, and the pressure regulating liquid 18 is water like the working liquid 12.

The gas 100 is preferably slightly soluble in the pressure regulating liquid 18. In this example, helium slightly soluble in water is used as the gas 100. The pressure regulating container 16 may alternatively be filled with only the pressure regulating liquid 18.

The pressure regulating container 16 and the connecting pipe 17 are preferably formed of a material high in heat insulation ability. According to this embodiment, water is used as the pressure regulating liquid 18, and therefore, the pressure regulating container 16 and the connecting pipe 17 are made of stainless steel.

A piston mechanism 19 making up a pressure regulating means for regulating the internal pressure Pt of the pressure regulating container 16 (hereinafter sometimes referred to as the regulating container internal pressure) is configured of a pressure regulating piston 19*a* and an electrically-operated actuator 19*b*.

The pressure regulating piston 19*a* is disposed at the upper end in the pressure regulating container 16 and is adapted to reciprocate vertically by the electrically-operated actuator 19*b* external to the pressure regulating container 16.

Next, an electronic control unit according to this embodiment is briefly explained. The control unit 21 is configured of a well-known microcomputer including a CPU, ROM, RAM, etc. and peripheral circuits, and corresponds to the control means according to the invention.

In order to control the piston mechanism 19, the control unit 21 is supplied with detection signals from a heated portion temperature sensor 22 for detecting the temperature T1 of the heated portion 11*a* (hereinafter sometimes referred to as the heated portion temperature) and a regulating container internal pressure sensor 23 for detecting the regulating container internal pressure Pt. The control unit 21 controls the drive of the electrically-operated actuator 19*b* based on the detection signals from the sensors 22, 23.

Now, the operation in the configuration described above is explained with reference to FIG. 2. Upon activation of the heater 13 and the cooler 14, the working liquid (water) 12 in the heated portion 11*a* is heated and vaporized by the heater 13, and the high-temperature high-pressure vapor of the working liquid 12 is accumulated in the heated portion 11*a*, thereby pressing down the liquid level of the working liquid 12 in the first linear portion 11*e*. Then, the working liquid 12 sealed in the container 11 is displaced toward the second linear portion 11*f* from the first linear portion 11*e* and pushes up the piston 15 on the side of the power generator 1.

Once the liquid level of the working liquid 12 in the first linear portion 11*e* of the container 11 falls to the cooled portion 11*b* and the vapor of the working liquid 12 advances into the cooled portion 11*b*, the particular vapor is cooled and liquefied by the cooler 14. Thus, the force to press down the liquid level of the working liquid 12 in the first linear portion 11*e* is lost, and the liquid level of the first linear portion 11*e* rises. As a result, the piston 15 on the side of the power generator 1 that has been pushed up by the expansion of the vapor of the working liquid 12 moves down.

This operation is repeatedly carried out until the operation of the heater 13 and the cooler 14 comes to stop. In the process, the working liquid 12 in the container 11 is periodically displaced (what is called by self-vibration) thereby to vertically move the movable element 2 of the power generator 1.

The present inventor, through experiment and analysis, has acquired knowledge, described below, about the relation between the peak value Pc1 of the in-container pressure Pc and the performance (output and efficiency) of the external combustion engine 10.

Figure 3A:
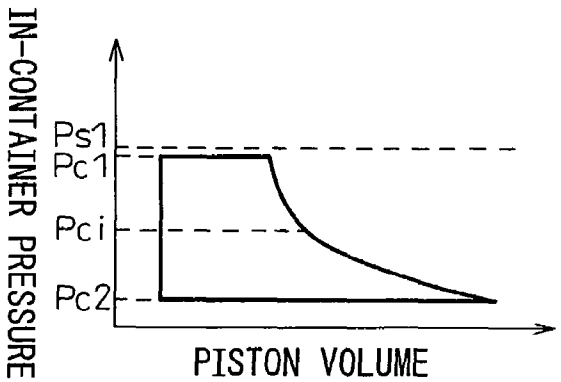
FIG. 3A is a PV diagram showing the ideal state of the external combustion engine according to the first embodiment.

FIG. 3A is a PV diagram in one state of the external combustion engine 10. In this PV diagram, the abscissa represents the volume of the space defined by the container 11 and the piston 15 (hereinafter referred to as the piston volume). This piston volume changes with the reciprocal motion of the piston 15. The abscissa of the PV diagram shown in FIGS. 3B, 3C described later is also similar.

FIG. 3A is a PV diagram showing a state in which the peak value Pc1 of the in-container pressure Pc is lower than, and nearest to, the saturation vapor pressure Ps1 of the working liquid 12 at the heated portion temperature T1. This is an ideal state in which the work done per period by the external combustion engine is largest and therefore the performance (output and efficiency) of the external combustion engine 10 is increased.

Figure 3B:
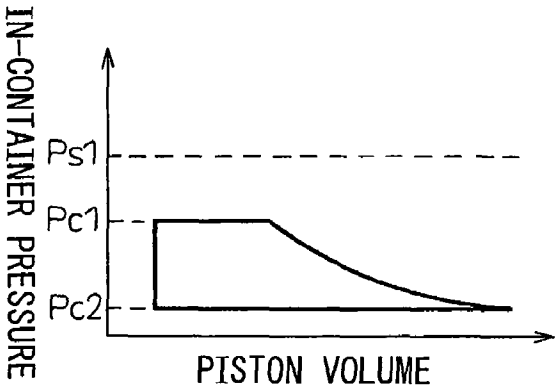
FIG. 3B is a PV diagram showing the external combustion engine according to the first embodiment, in which the peak value of the internal pressure of the container is lower than the saturation vapor pressure.

FIG. 3B shows a PV diagram with the peak value Pc1 extremely lower than the saturation vapor pressure Ps1. Under this condition, the work done per period is so small that the performance (output and efficiency) of the external combustion engine 10 is reduced.

Figure 3C:
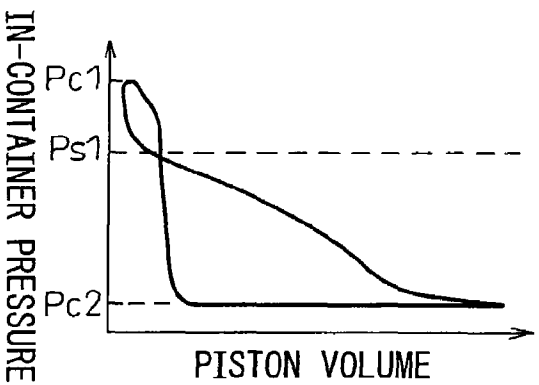
FIG. 3C is a PV diagram showing the external combustion engine according to the first embodiment, in which the peak value of the internal pressure of the container is higher than the saturation vapor pressure.

FIG. 3C shows a PV diagram in the case where the peak value Pc1 is larger than the saturation vapor pressure Ps1. Specifically, with the increase in the heated portion temperature T1, the high-temperature vapor exists in the heater 12 even in the case where the piston 15 is located at bottom dead center (highest point in FIG. 1) and the piston volume is maximum.

In the process, the piston 15 moves from the bottom dead center toward the top dead center (lowest point in FIG. 1), and with the reduction in piston volume, the vapor of the working liquid 12 is compressed. Thus, the in-container pressure Pc rises, and the working liquid 12, advancing into the heated portion 11*a*, is heated and vaporized, so that the in-container pressure Pc further rises. As a result, the peak value Pc1 exceeds the saturation vapor pressure Ps1.

As described above, the peak value Pc1, as long as it is larger than the saturation vapor pressure Ps1, is higher than the saturation vapor pressure Ps1. Therefore, part of the vapor of the working liquid 12 is condensed and liquefied. As a result, the negative work for moving the piston 15 downwardly is done, thereby reducing the performance (output and efficiency) of the external combustion engine 10.

In order to improve the performance (output and efficiency) of the external combustion engine 10 most effectively, the peak value Pc1 of the in-container pressure Pc is required to be kept lower than the saturation vapor pressure Ps1 of the working liquid 12 at the heated portion temperature T1 on the one hand and required to be kept as near to the saturation vapor pressure Ps1 as possible on the other hand.

Figure 7:
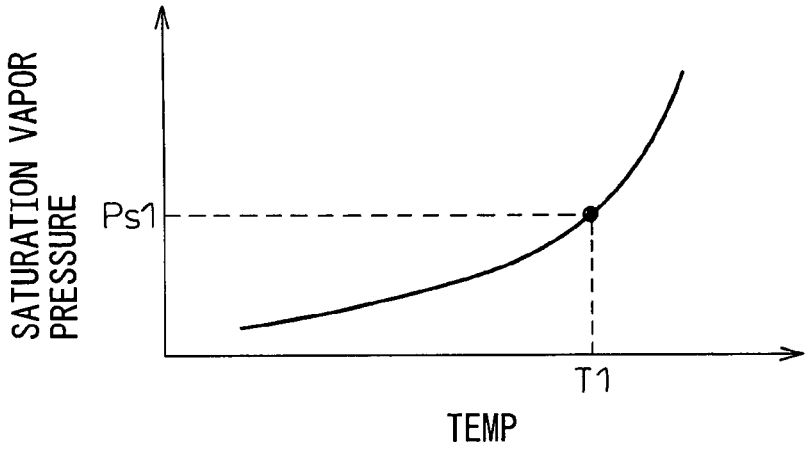
FIG. 7 is a graph showing the vapor pressure curve of the working liquid.

As is well known, however, with the change of the heated portion temperature T1, the saturation vapor pressure Ps1 of the working liquid 12 changes (see FIG. 7 described later). Also, the peak value Pc1 of the in-container pressure Pc changes due to the change in the heated portion temperature T1 and the temperature T2 of the cooled portion 11*b* (hereinafter referred to as the cooled portion temperature) and the leak of the working liquid 12 from the container 11.

Specifically, once the heated portion temperature T1 and the cooled portion temperature T2 are reduced and the temperature of the liquid-phase working liquid 12 drops due to the decrease of the temperature of the high-temperature gas providing a heat source of the heater 13 or the temperature of the cooling water circulating in the cooler 14, the liquid-phase working liquid 12 is thermally contracted and the volume of the liquid-phase working liquid 12 decreases. Also, the leakage of the working liquid 12, bit by bit, from the container 11 also reduces the volume of the liquid-phase working liquid 12.

Figure 4A:
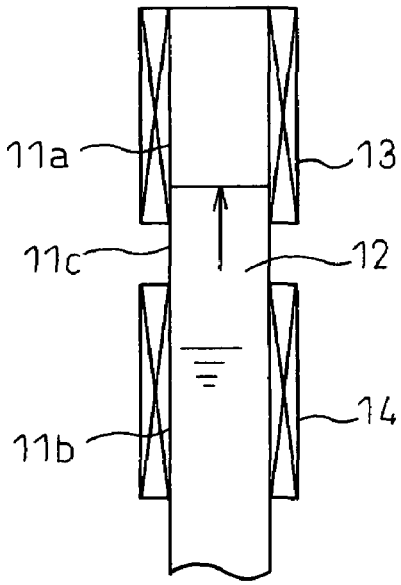
FIG. 4A is a diagram for explaining the problem posed by the conventional steam engine in which the volume of the working liquid 12 is decreased.

With the volume reduction of the liquid-phase working liquid 12, as shown in FIG. 4A, the liquid-phase working liquid 12 cannot sufficiently advance into the heated portion 11*a* even in the case where the piston 15 is located at the top dead center (lowest point in FIG. 1) and the piston volume is minimum.

As a result, the vaporization of the working liquid 12 in the heated portion 11*a* is suppressed and,the peak value Pc1 of the in-container pressure Pc is reduced.

Figure 4B:
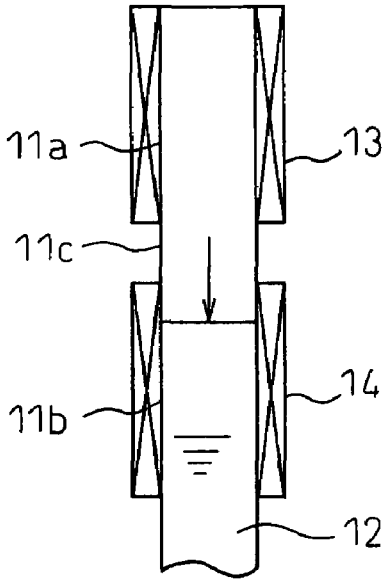
FIG. 4B is a diagram for explaining the problem posed by the conventional steam engine in which the volume of the working liquid 12 is increased.

With the increase in the heated portion temperature T1 and the cooled portion temperature T2, on the other hand, the liquid-phase working liquid 12 is thermally expanded and the volume thereof is increased. With the increase in the volume of the liquid-phase working liquid 12, as shown in FIG. 4B, the vapor of the working liquid 12 cannot sufficiently advance into the cooled portion 11*b* even in the case where the piston 15 is located at the bottom dead center (highest point in FIG. 1) and the piston volume is maximum.

As a result, the liquefaction of the vapor of the working liquid 12 in the cooled portion 11*b* is suppressed, and the peak value Pc1 of the in-container pressure Pc increases.

Figure 5:
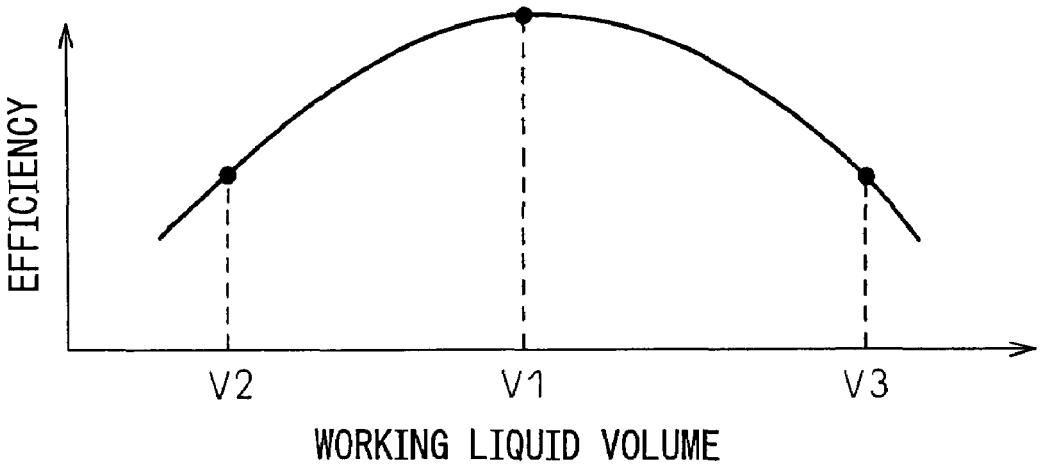
FIG. 5 is a graph showing the relation between the volume of the working liquid and the efficiency of the external combustion engine.

FIG. 5 is a graph showing the relation between the volume of the working liquid 12 and the efficiency of the external combustion engine 10. Though not shown, a similar relation to FIG. 5 is held between the volume of the working liquid 12 and the output of the external combustion engine 10.

As understood from FIG. 5, the performance (output and efficiency) of the external combustion engine 10 is highest in the case where the volume of the working liquid 12 assumes a predetermined value V1. Under this condition, the PV diagram is in the form shown in FIG. 3A.

In the case where the volume of the working liquid 12 is V2 which is smaller than the predetermined volume V1, on the other hand, the PV diagram assumes the form as shown in FIG. 3B, and the performance (output and efficiency) of the external combustion engine 10 is reduced. In the case where the volume of the working liquid 12 is V3 which is larger than the predetermined volume V1, the PV diagram assumes the form as shown in FIG. 3C, and the performance (output and efficiency) of the external combustion engine 10 is reduced.

According to this embodiment, therefore, the in-container pressure Pc is adjusted with the change in the heated portion temperature T1 so that the peak value Pc1 of the in-container pressure Pc is lower than and as near as possible to the saturation vapor pressure Ps1 of the working liquid 12 at the heated portion temperature T1 during the operation of the external combustion engine 10. In this way, the reduction in the performance (output and efficiency) of the external combustion engine 10 which otherwise might be caused by the change in the saturation vapor pressure Ps1 or the change in the peak value Pc1 of the in-container pressure Pc is suppressed.

Figure 6:
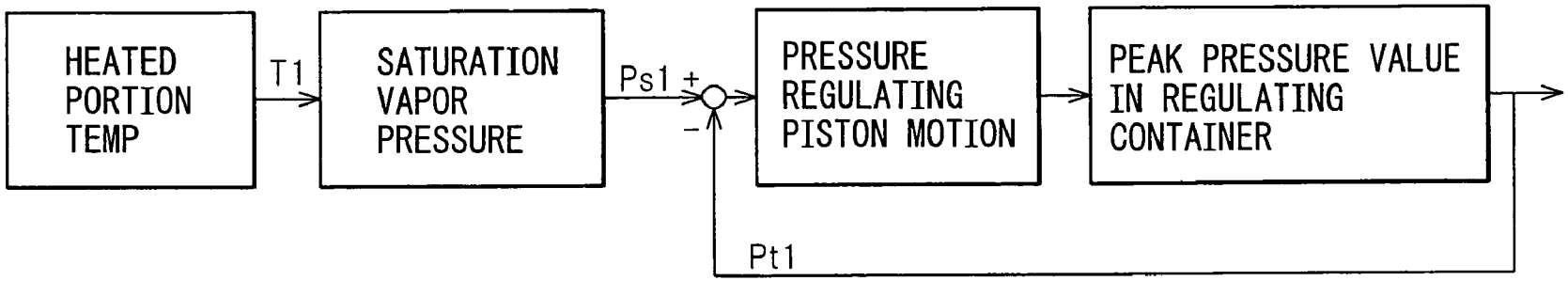
FIG. 6 is a block diagram schematically showing the control operation according to the first embodiment of the invention.

FIG. 6 is a block diagram schematically showing the control operation according to this embodiment. First, based on the heated portion temperature T1 and the vapor pressure curve of the working liquid 12 shown in FIG. 7, the saturation vapor pressure Ps1 of the working liquid 12 at the heated portion temperature T1 is calculated.

In the case where the peak value Pt1 of the regulating container internal pressure Pt is lower than the saturation vapor pressure Ps1, the electrically-operated actuator 19*b* pushes out the pressure regulating piston 19*a* and reduces the volume of the pressure regulating container 16. As a result, the pressure regulating liquid 18 is compressed and the regulating container internal pressure Pt rises, and so does the peak value Pt1 of the regulating container internal pressure Pt.

In the case where the peak value Pt1 of the regulating container internal pressure Pt is higher than the saturation vapor pressure Ps1, on the other hand, the electrically-operated actuator 19*b* pulls in the pressure regulating piston 19*a* and increases the volume of the pressure regulating container 16. As a result, the pressure regulating liquid 18 is expanded and the regulating container internal pressure Pt falls, and so does the peak value Pt1.

In view of the fact that the container 11 communicates with the pressure regulating container 16 through the connecting pipe 17, the in-container pressure Pc follows the regulating container internal pressure Pt. As a result, the peak value Pc1 of the in-container pressure Pc can be approximated to the saturation vapor pressure Ps1 of the working liquid 12.

Consequently, the operating condition of the external combustion engine 10 can be always approximated to the ideal state, and therefore the reduction in the performance (output and efficiency) of the external combustion engine 10, which otherwise might be caused by the change in the saturation vapor pressure Ps1 or the change in the peak value Pc1 of the in-container pressure Pc, is prevented.

As is well known, the compressibility of a liquid is lower than that of a gas. In the case where the pressure regulating container 18 is filled up with the pressure regulating liquid 18 alone, therefore, the change amount of the regulating container internal pressure Pt excessively increases as compared with the displacement amount of the pressure regulating piston 19*a*, thereby making it difficult to finely adjust the regulating container internal pressure Pt.

According to this embodiment, the gas 100 higher in compressibility than the pressure regulating liquid 18, as well as the pressure regulating liquid 18, is sealed in the pressure regulating container 18. Therefore, the change amount of the regulating container internal pressure Pt with respect to the displacement amount of the pressure regulating piston 19*a* can be suppressed. As a result, the fine adjustment of the regulating container internal pressure Pt is facilitated.

Although this embodiment employs water as the pressure regulating liquid 18, like the working liquid 12, in the pressure regulating container 16, a liquid such as a liquid metal lower in compressibility than the working liquid 12 can alternatively be used as the pressure regulating liquid 18.

In this case, the disadvantage is that the fine adjustment of the regulating container internal pressure Pt is more difficult than in the case where the same liquid as the working liquid 12 is employed as the pressure regulating liquid 18. Since the displacement amount of the pressure regulating piston 19*a* can be reduced, however, the external combustion engine 10 can be advantageously made less bulky.

In the case where a liquid metal is used as the pressure regulating liquid 18, the fact that the specific gravity of the liquid metal is larger than that of the working liquid (water) 12 makes it desirable to dispose the pressure regulating container 16 under the bent portion 11*d* thereby to prevent the pressure regulating liquid 18 from mixing with the working liquid 12.

Second Embodiment

According to the first embodiment described above, the reduction in the performance (output and efficiency) of the external combustion engine 10 which otherwise might be caused by the change in the saturation vapor pressure Ps1 or the change in the peak value Pc1 of the in-container pressure Pc is prevented by reducing the peak value Pc1 of the in-container pressure Pc below but as near as possible to the saturation vapor pressure Ps1. According to the second embodiment, on the other hand, the reduction in the performance (output and efficiency) of the external combustion engine 10 which otherwise might be caused by the change in the saturation vapor pressure Ps1 or the change in the peak value Pc1 of the in-container pressure Pc is prevented by approximating the average value Pca of the in-container pressure Pc to the target value Pc0.

The average value Pca of the in-container pressure Pc is defined as a value obtained during the self-vibration of the working liquid 12 for one period, and the target value Pc0 as a value approximate to the average value (hereinafter referred to as the ideal average value. See FIG. 3A) Pci of the in-container pressure Pc in the ideal state associated with the highest performance (output and efficiency) of the external combustion engine 10.

Figure 8:
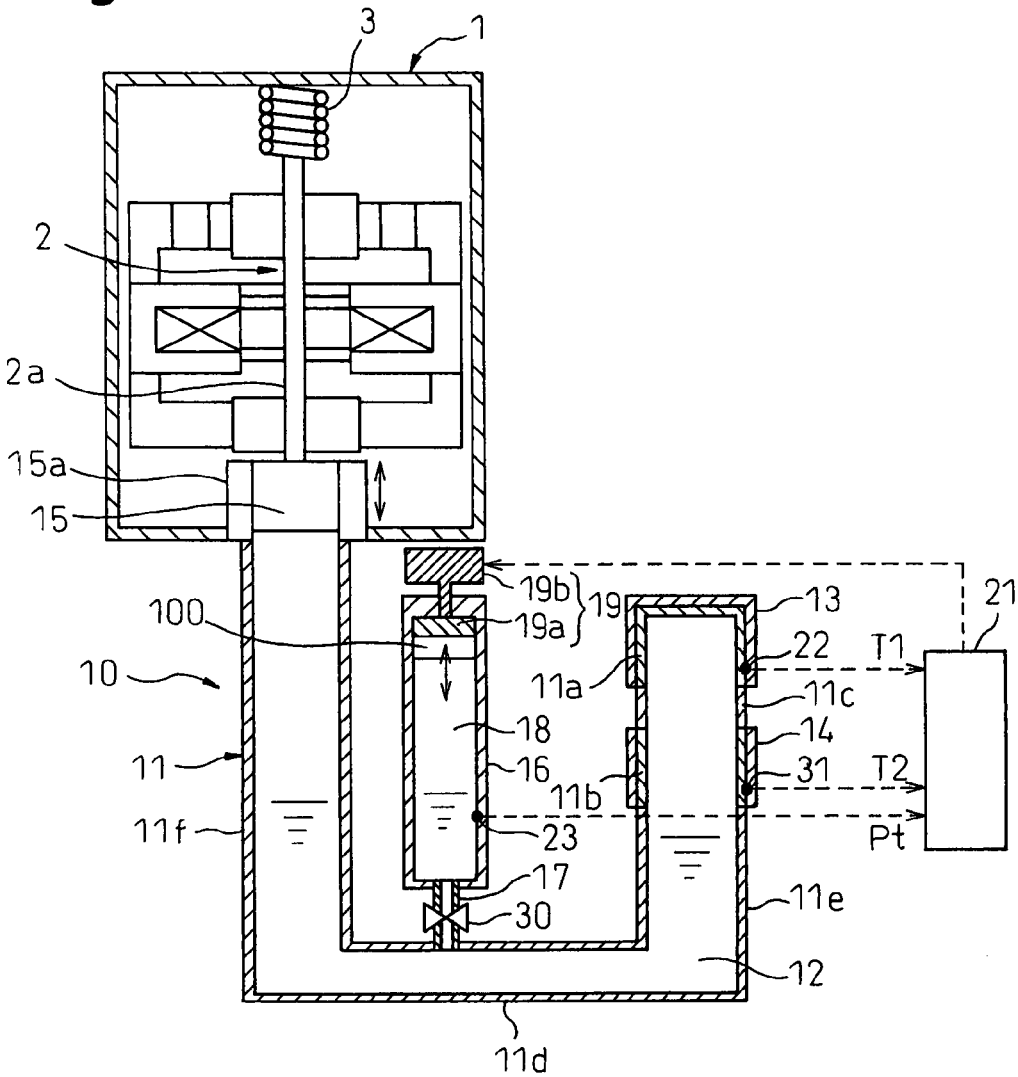
FIG. 8 is a diagram showing a general configuration of a power generating system according to a second embodiment of the invention.

FIG. 8 is a diagram showing a general configuration of the power generating system according to this embodiment. According to this embodiment, the connecting pipe 17 is formed with a restrictor 30 for suppressing the propagation of the in-container pressure Pc in the pressure regulating container 16. This restrictor 30 reduces the diameter of the flow path of the connecting pipe 17. As a result, the change in the regulating container internal pressure Pt following the periodic change in the in-container pressure Pc is suppressed, and therefore the regulating container internal pressure Pt is settled at substantially the same level as the average value Pca of the in-container pressure Pc.

Also, the control unit 21 is supplied with a detection signal from a cooled portion temperature sensor 31 for detecting the temperature (hereinafter referred to as the cooled portion temperature) T2 of the cooled portion 11*b* in order to set the target value Pc0.

Figure 9:
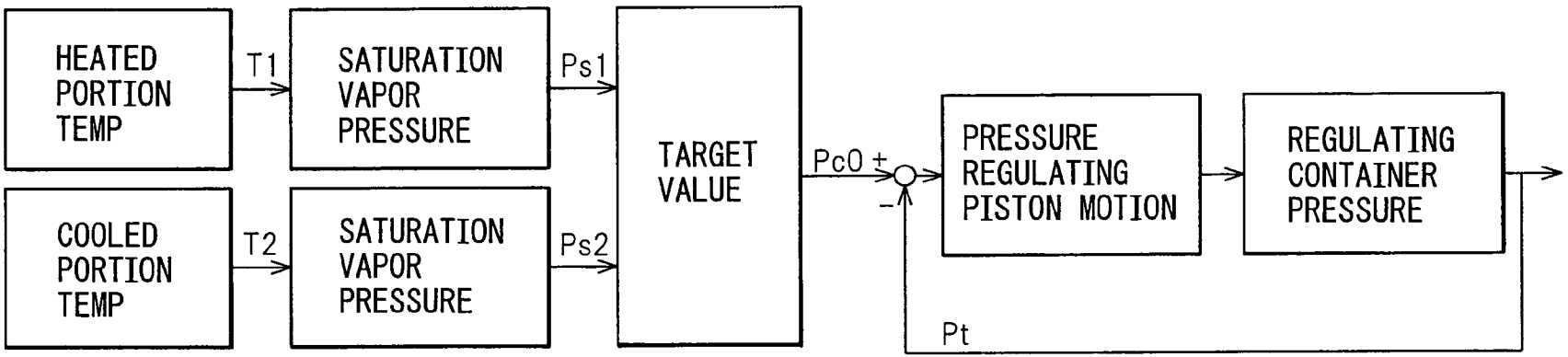
FIG. 9 is a block diagram schematically showing the control operation according to the second embodiment of the invention.

FIG. 9 is a block diagram schematically showing the control operation of the in-container pressure Pc according to this embodiment. In this embodiment, the saturation vapor pressure Ps2 of the working liquid 12 at the cooled portion temperature T2 is calculated based on the cooled portion temperature T2 and the vapor pressure curve of the working liquid 12 shown in FIG. 7. The saturation vapor pressure Ps2 of the working liquid 12 at the cooled portion temperature T2 is equal to the minimum value Pc2 (FIGS. 3A to 3C) during one period of the in-container pressure Pc.

Next, the target value Pc0 is calculated based on the saturation vapor pressure Ps1 of the working liquid 12 at the heated portion temperature T1 and the saturation vapor pressure Ps2 of the working liquid 12 at the cooled portion temperature T2. According to this embodiment, the target value Pc0 is set to the intermediate value between or, more specifically, a substantial average value of, the saturation vapor pressure Ps1 of the working liquid 12 at the heated portion temperature T1 and the saturation vapor pressure Ps2 of the working liquid 12 at the cooled portion temperature T2.

In the case where the regulating container internal pressure Pt is lower than the target value Pc0, the electrically-operated actuator 19*b* pushes out the pressure regulating piston 19*a* and reduces the volume of the pressure regulating container 16. As a result, the pressure regulating liquid 18 is compressed and the regulating container internal pressure Pt increases.

In the case where the regulating container internal pressure Pt is higher than the target value Pc0, on the other hand, the pressure regulating piston 19*a* is pulled in thereby to reduce the volume of the pressure regulating container 16. As a result, the pressure regulating liquid 18 is expanded and the regulating container internal pressure Pt is decreased.

Then, the average value Pca of the in-container pressure PC follows the regulating container internal pressure Pt, and the average value Pca of the in-container pressure Pc approaches the target value Pc0. In other words, the average value Pca of the in-container pressure Pc approaches the ideal average value Pci.

As a result, the operating condition of the external combustion engine 10 can always be approximated to the ideal state, and therefore the reduction in the performance (output and efficiency) of the external combustion engine 10 which otherwise might be caused by the change in the saturation vapor pressure Ps1 or the change in the peak value Pc1 of the in-container pressure Pc is prevented.

In the first embodiment described above, the peak value Pt1 of the regulating container internal pressure Pt is detected. In view of the fact that the regulating container internal pressure Pt assumes the peak value Pt1 for a very short time, however, the sensing period of the regulating container internal pressure sensor 23 to detect the regulating container internal pressure Pt is very short.

According to this embodiment, in contrast, the regulating container internal pressure Pt is settled at a pressure substantially equal to the average value Pca of the in-container pressure Pc without changing following the in-container pressure Pc. As a result, the sensing period of the regulating container internal pressure sensor 23 for detecting the regulating container internal pressure Pt can be lengthened than in the first embodiment described above.

As a result, the regulating container internal pressure Pt can be detected more easily than in the first embodiment, and therefore the performance (output and efficiency) of the external combustion engine 10 can be improved more easily than in the first embodiment.

Third Embodiment

In the second embodiment described above, the regulating container internal pressure Pt is approximated to the target value Pc0 by increasing and decreasing the volume of the pressure regulating container 16. According to the third embodiment, in contrast, as shown in FIG. 10, the regulating container internal pressure Pt is approximated to the target value Pc0 by increasing and decreasing the volume of the pressure regulating liquid 18 in the pressure regulating container 16.

Figure 10:
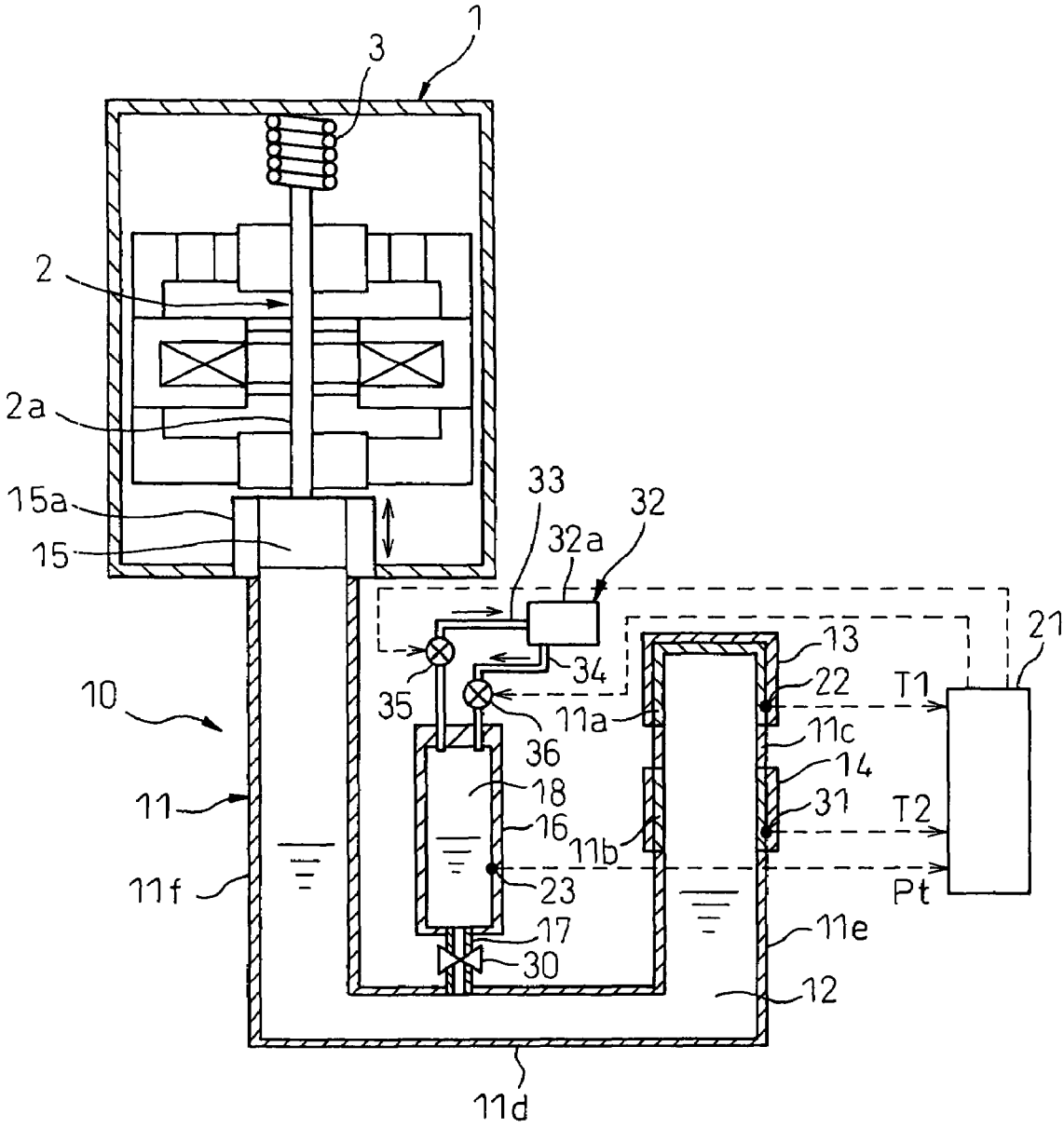
FIG. 10 is a diagram showing a general configuration of a power generating system according to a third embodiment of the invention.

FIG. 10 is a diagram showing a general configuration of the power generating system according to this embodiment. According to this embodiment, unlike in the second embodiment, the pressure regulating means consists of a pump mechanism 32 instead of the piston mechanism 19. The pump mechanism 32 comprises a pump 32*a*, an intake pipe 33, a discharge pipe 34, an intake on/off valve 35 and a discharge on/off valve 36.

The pump 32*a* for sucking in the pressure regulating liquid 18 in the pressure regulating container 16 and storing it therein while at the same time discharging the internally stored pressure regulating liquid 18 to the pressure regulating container 16 is connected to the pressure regulating container 16 through the intake pipe 33 and the discharge pipe 34.

The intake on/off valve 35 is disposed in the intake pipe 33, and when open, the pressure regulating liquid 18 in the pressure regulating container 16 is sucked in by and stored in the pump 32*a*.

The discharge pipe 34 includes the discharge on/off valve 36, and when open, the pressure regulating liquid 18 stored in the pump 32*a* is discharged into the pressure regulating container 16. The operation of the on/off valves 35, 36 is controlled by the control unit 21.

Figure 11:
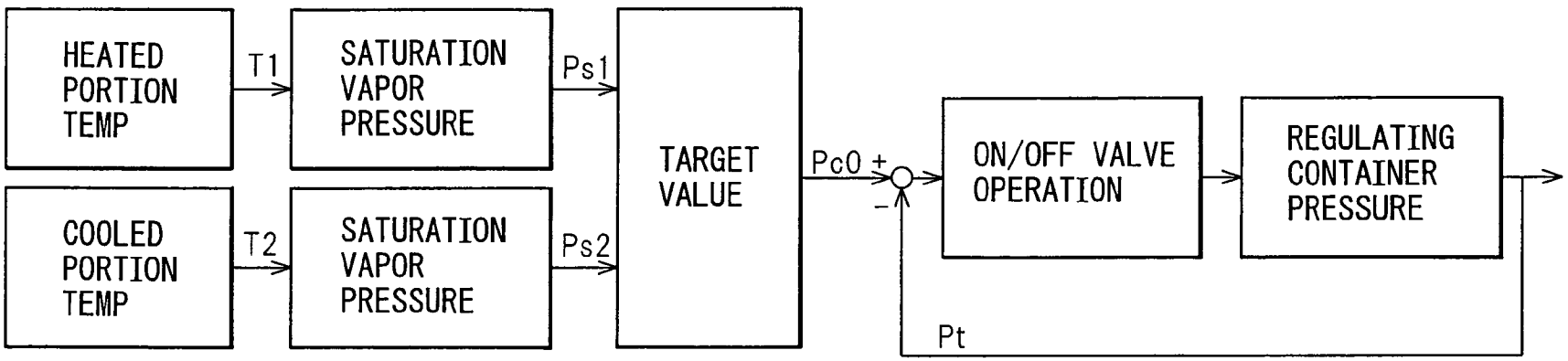
FIG. 11 is a block diagram schematically showing the control operation according to the third embodiment of the invention.

FIG. 11 is a block diagram schematically showing the operation of controlling the in-container pressure Pc according to this embodiment. According to this embodiment, in the case where the regulating container internal pressure Pt is lower than the target value Pc0, the intake on/off valve 35 is closed while the discharge on/off valve 36 is opened thereby to increase the volume of the pressure regulating liquid 18. As a result, the regulating container internal pressure Pt increases.

In the case where the regulating container internal pressure Pt is higher than the target value Pc0, on the other hand, the intake on/off valve 35 opens and the discharge on/off valve 36 is closed thereby to reduce the volume of the pressure regulating liquid 18 in the pressure regulating container 16. As a result, the regulating container internal pressure Pt is decreased.

Then, as in the second embodiment, the average value Pca of the in-container pressure Pc approaches the target value Pc0. As a result, the operating condition of the external combustion engine 10 can always be approximated to the ideal state, and therefore the reduction in the performance (output and efficiency) of the external combustion engine 10 which otherwise might be caused by the change in the saturation vapor pressure Ps1 or the change in the peak value Pc1 of the in-container pressure Pc is prevented.

According to this embodiment, as in the second embodiment, the reduction in the performance (output and efficiency) of the external combustion engine 10 which otherwise might be caused by the change in the saturation vapor pressure Ps1 or the change in the peak value Pc1 of the in-container pressure Pc is prevented by approximating the average value Pca of the in-container pressure Pc to the target value Pc0. Nevertheless, as in the first embodiment described above, the reduction in the performance (output and efficiency) of the external combustion engine 10 which otherwise might be caused by the change in the saturation vapor pressure Ps1 or the change in the peak value Pc1 of the in-container pressure Pc can be prevented by reducing the peak value Pc1 of the in-container pressure Pc below the saturation vapor pressure Ps1 and approximating it as near to the saturation vapor pressure Ps1 as possible.

Fourth Embodiment

In the third embodiment described above, the in-container pressure Pc is regulated using a single pressure regulating container 16. According to the fourth embodiment, in contrast, as shown in FIG. 12, the in-container pressure Pc is regulated using two pressure regulating containers 37, 38.

Figure 12:
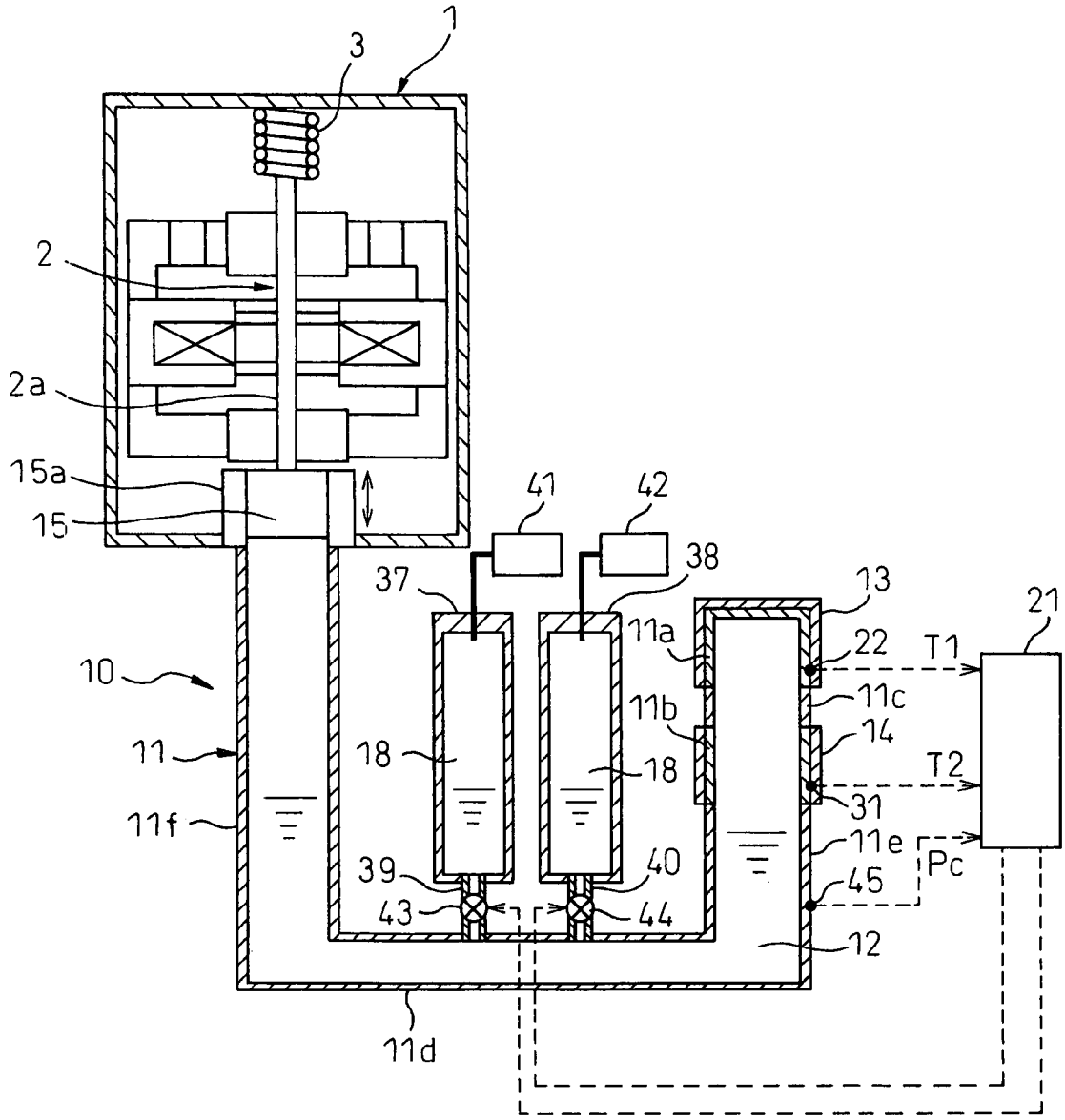
FIG. 12 is a diagram showing a general configuration of a power generating system according to a fourth embodiment of the invention.

FIG. 12 is a diagram showing a general configuration of the power generating system according to this embodiment. In this embodiment, two pressure regulating containers 37, 38 are arranged through connecting pipes 39, 40, respectively, in place of the pressure regulating container 16 according to the third embodiment.

The two pressure regulating containers 37, 38 are connected with pumps 41, 42, respectively, for applying different pressures to the interior of the pressure regulating containers 37, 38, respectively, and on/off valves 43, 44 are disposed in the two connecting pipes 39, 40, respectively. The on/off operation of the on/off valves 43, 44 is controlled independently of each other by the control unit 21.

Also, according to this embodiment, the regulating container internal pressure sensor 23 for detecting the regulating container internal pressure Pt is lacking and, as an alternative, the detection signal from the in-container pressure sensor 45 for detecting the in-container pressure Pc is input to the control unit 21.

The internal pressure of the pressure regulating container 37, in particular, is kept at a level higher than the target value Pc0 by the pump 41, while the internal pressure of the other pressure regulating container 38 is kept at a level lower than the target value Pc0 by the pump 42.

Figure 13:
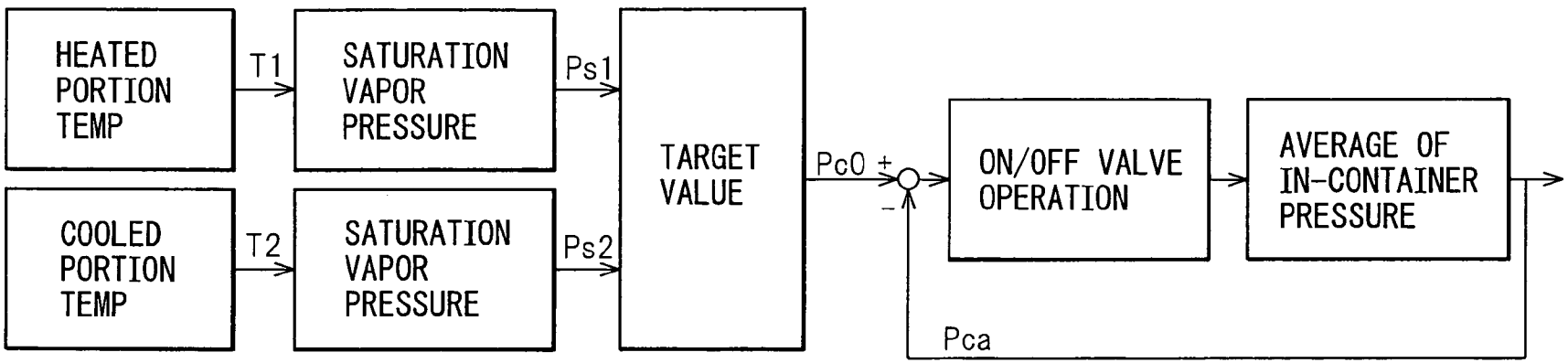
FIG. 13 is a block diagram schematically showing the control operation according to the fourth embodiment of the invention.

FIG. 13 is a block diagram schematically showing the operation of controlling the in-container pressure Pc according to this embodiment. According to this embodiment, in the case where the average value Pca of the in-container pressure Pc is lower than the target value Pc0, the on/off valve 43 of the pressure regulating container 37 is opened while the on/off valve 44 of the other pressure regulating container 38 is closed. As a result, the in-container pressure Pc is increased.

In the case where the average value Pca of the in-container pressure Pc is higher than the target value Pc0, on the other hand, the on/off valve 43 of the pressure regulating container 37 is closed while the on/off valve 44 of the other pressure regulating container 38 is opened. As a result, the in-container pressure Pc is decreased.

Then, as in the third embodiment, the average value Pca of the in-container pressure Pc approaches the target value Pc0. As a result, the operating condition of the external combustion engine 10 can always be approximated to the ideal state, and therefore the reduction in the performance (output and efficiency) of the external combustion engine 10 which otherwise might be caused by the change in the saturation vapor pressure Ps1 or the change in the peak value Pc1 of the in-container pressure Pc is prevented.

According to this embodiment, the two pressure regulating containers 37, 38 are kept at different pressures by different pumps 41, 42, and can alternatively be kept at different pressures by a single pump.

Also, according to this embodiment, three or more instead of two pressure regulating containers 37, 38 kept at different pressures can be used.

In such a case, each of the three or more pressure regulating containers includes an on/off valve, so that in the case where the average value. Pca of the in-container pressure Pc is lower than the target value Pc0, only the on/off valve of that one of the three pressure regulating containers which has the internal pressure lower than and nearest to the target value Pc0 is opened, while in the case where the average value Pca of the in-container pressure Pc is lower than the target value Pc0, only the on/off valve of that one of the three pressure regulating containers which has the internal pressure higher than and nearest to the target value Pc0 is opened.

Fifth Embodiment

According to the second embodiment described above, the regulating container internal pressure Pt is approximated to the target value Pc0 by increasing and decreasing the volume of the pressure regulating container 16, and according to the third embodiment, the regulating container internal pressure Pt is approximated to the target value Pc0 by increasing and decreasing the volume of the pressure regulating liquid 18 in the pressure regulating container 16. According to the fifth embodiment, on the other hand, as shown in FIG. 14, the regulating container internal pressure Pt is approximated to the target value Pc0 by vaporizing the pressure regulating liquid 18 in the pressure regulating container 16.

Figure 14:
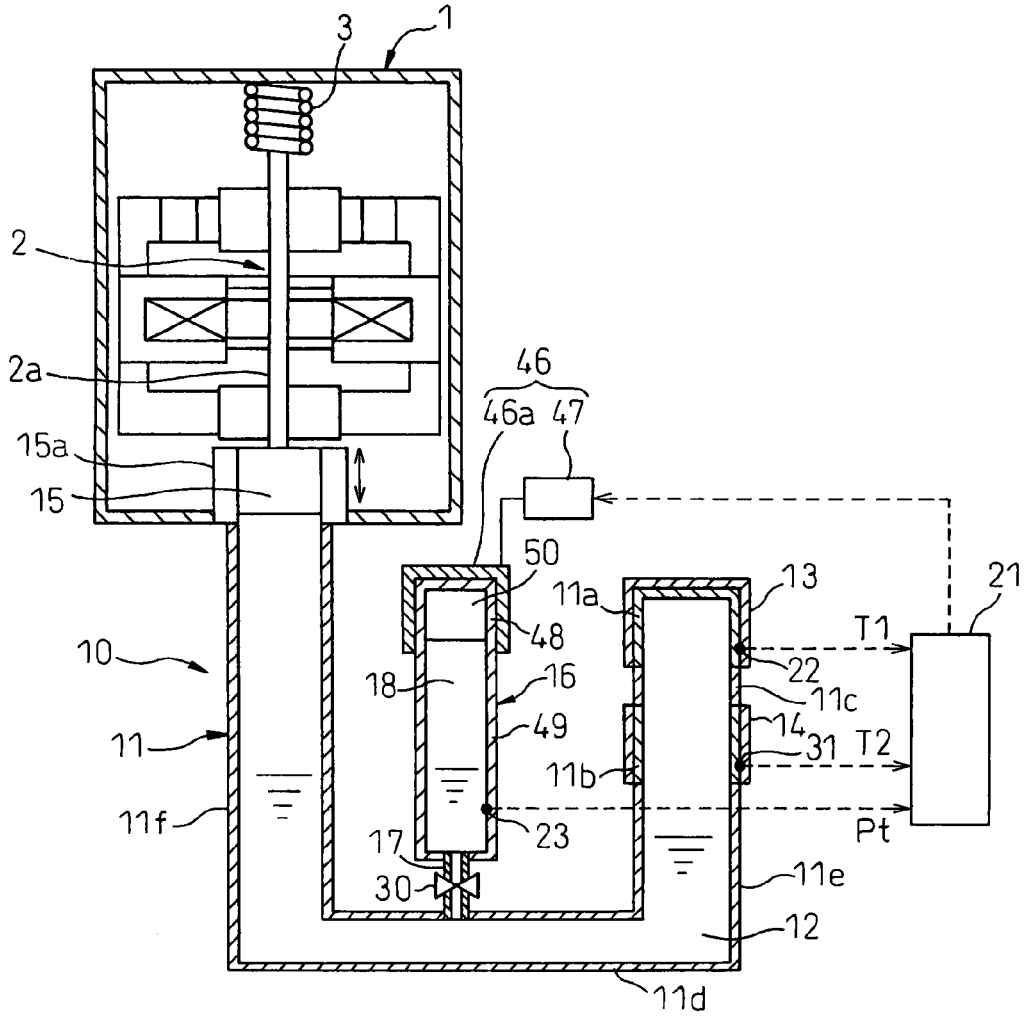
FIG. 14 is a diagram showing a general configuration of a power generating system according to a fifth embodiment of the invention.

FIG. 14 is a diagram showing a general configuration of the power generating system according to this embodiment. In this embodiment, unlike in the second embodiment, the pressure regulating means consists of a heating means 46 for heating and vaporizing the pressure regulating liquid 18 instead of using the piston mechanism 19.

This heating means 46 comprises an electric heater 46*a* arranged closely on the outer surface of the portion of the pressure regulating container 16 far from the connecting pipe 17 (at the upper end in FIG. 11) and a temperature controller 47 for regulating the temperature of the electric heater 46*a*.

The amount of heat Q1 applied from the electric heater 46*a* to the pressure regulating liquid 18 is regulated by the control 21 controlling the temperature controller 47.

According to this embodiment, the pressure regulating container 16 is filled up with the pressure regulating liquid 18 alone. Like in the first and second embodiment, however, the gas 100 can be sealed in the pressure regulating container 16.

Figure 15:
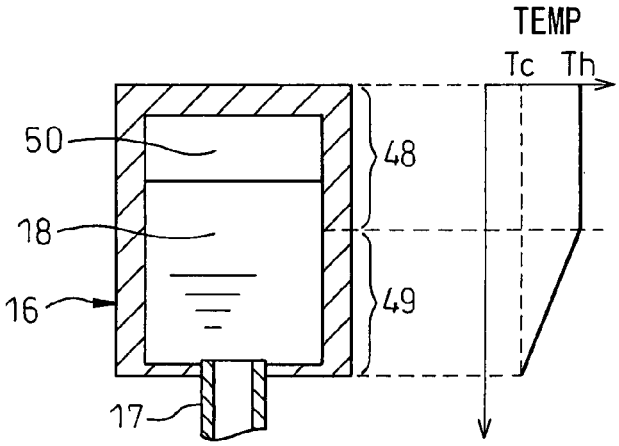
FIG. 15 is a graph showing the temperature gradient of the pressure regulating container according to the fifth embodiment of the invention.
Figure 16:
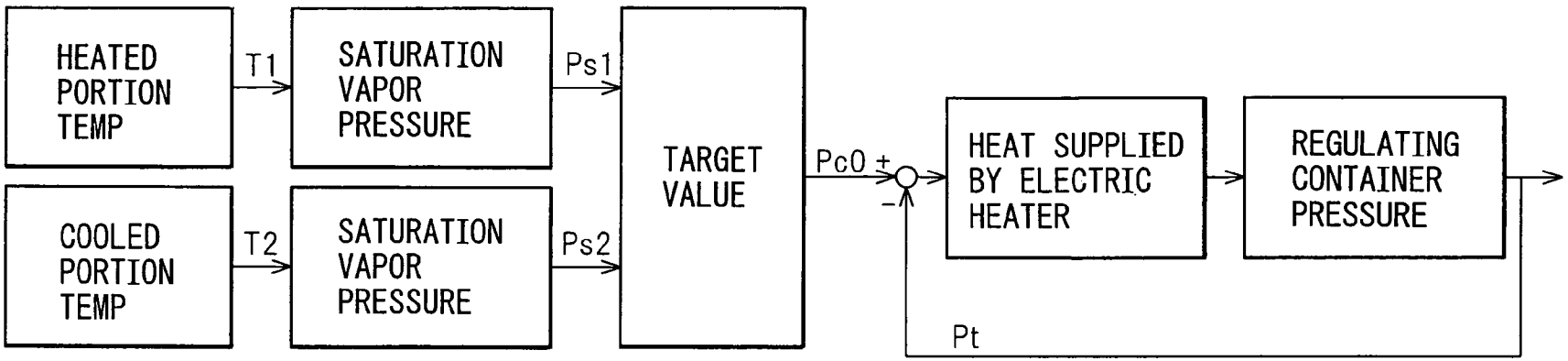
FIG. 16 is a block diagram schematically showing the control operation according to the fifth embodiment of the invention.

FIG. 15 is a graph showing the temperature gradient of the pressure regulating container 16 heated by the electric heater 46*a*. As shown in FIG. 12, the pressure regulating container 16 has such a structure for heat conduction that a high temperature portion 48 far from the connecting pipe 17 has an ignorably small temperature gradient while the low temperature portion 49 near to the connecting pipe 17 has a temperature gradient with the temperature progressively decreased away from the high temperature portion 48. In FIG. 12, the temperature Th is that of the high temperature portion 48 (hereinafter referred to as the high-temperature portion temperature).

The temperature Tc is that of the low temperature portion at the connecting pipe 17 side thereof (hereinafter referred to as the low-temperature portion temperature) and substantially equal to the cooled portion temperature T2 (more exactly, slightly higher than the cooled portion temperature T2). Therefore, the cooled portion temperature T2 is not higher than the boiling point of the pressure regulating liquid 18.

The pressure regulating liquid 18 in the high temperature portion 48 is heated and vaporized by the electric heater 46*a*, so that the vapor 50 high in temperature and pressure is stored in the high temperature portion 48 and pushes down the liquid level of the pressure regulating liquid 18 in the high temperature portion 48.

In the low temperature portion 49, on the other hand; the temperature decreases progressively with the distance away from the high temperature portion 48, and therefore the liquid level of the pressure regulating liquid 18 is kept in the high temperature portion 48 without being pushed down to the low temperature portion 49. As a result, the pressure regulating liquid 18 is kept in contact with the high temperature portion 48 and therefore the pressure regulating container 16 is kept in a boiling state. Thus, the regulating container internal pressure Pt can be maintained always at the same level as the saturation vapor pressure of the pressure regulating liquid 18 at the high-temperature portion temperature Th.

FIG. 13 is a block diagram schematically showing the operation of controlling the in-container pressure Pc according to this embodiment. According to this embodiment, in the case where the regulating container internal pressure Pt is lower than the target value Pc0, the temperature controller 47 increases the temperature of the electric heater 46*a* thereby to increase the high-temperature portion temperature Th of the pressure regulating container 16. As a result, the saturation vapor pressure of the pressure regulating liquid 18 increases and so does the regulating container internal pressure Pt.

In the case where the regulating container internal pressure Pt is higher than the target value Pc0, on the other hand, the temperature controller 47 decreases the temperature of the electric heater 46*a* thereby to decrease the high-temperature portion temperature Th of the pressure regulating container 16. As a result, the saturation vapor pressure of the pressure regulating liquid 18 decreases and so does the regulating container internal pressure Pt.

Then, as in the second and third embodiments, the average value Pca of the in-container pressure Pc approaches the target value Pc0. As a result, the operating condition of the external combustion engine 10 can always be approximated to the ideal state, and therefore the reduction in the performance (output and efficiency) of the external combustion engine 10 which otherwise might be caused by the change in the saturation vapor pressure Ps1 or the change in the peak value Pc1 of the in-container pressure Pc is prevented.

In this embodiment, the vapor 50 in the high temperature portion 48 may be either the pure vapor of the pressure regulating liquid 18 or a mixture of the vapor of the pressure regulating liquid 18 and the vapor of another gas (such as air).

Sixth Embodiment

Unlike in the fifth embodiment in which the regulating container internal pressure Pt is detected by the regulating container internal pressure sensor 23, the sixth embodiment is such that the regulating container internal pressure sensor 23 is eliminated and the regulating container internal pressure Pt is calculated based on the high-temperature portion temperature Th.

Figure 17:
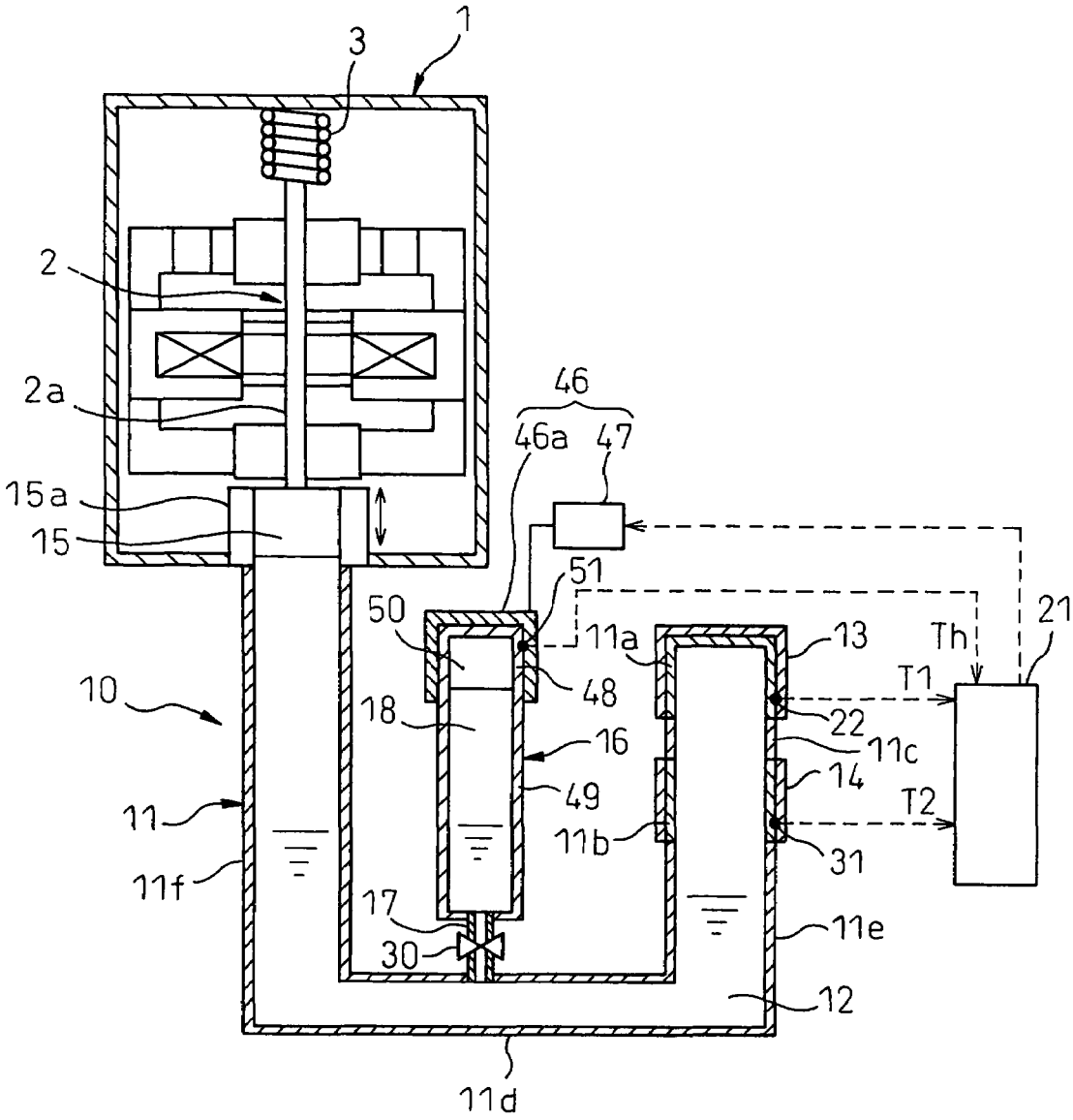
FIG. 17 is a diagram showing a general configuration of a power generating system according to a sixth embodiment of the invention.

FIG. 17 is a diagram showing a general configuration of the power generating system according to this embodiment. In this embodiment, the detection signal from the high-temperature portion temperature sensor 51 for detecting the high-temperature portion temperature Th is input to the control unit 21 to calculate the regulating container internal pressure Pt.

Figure 18:
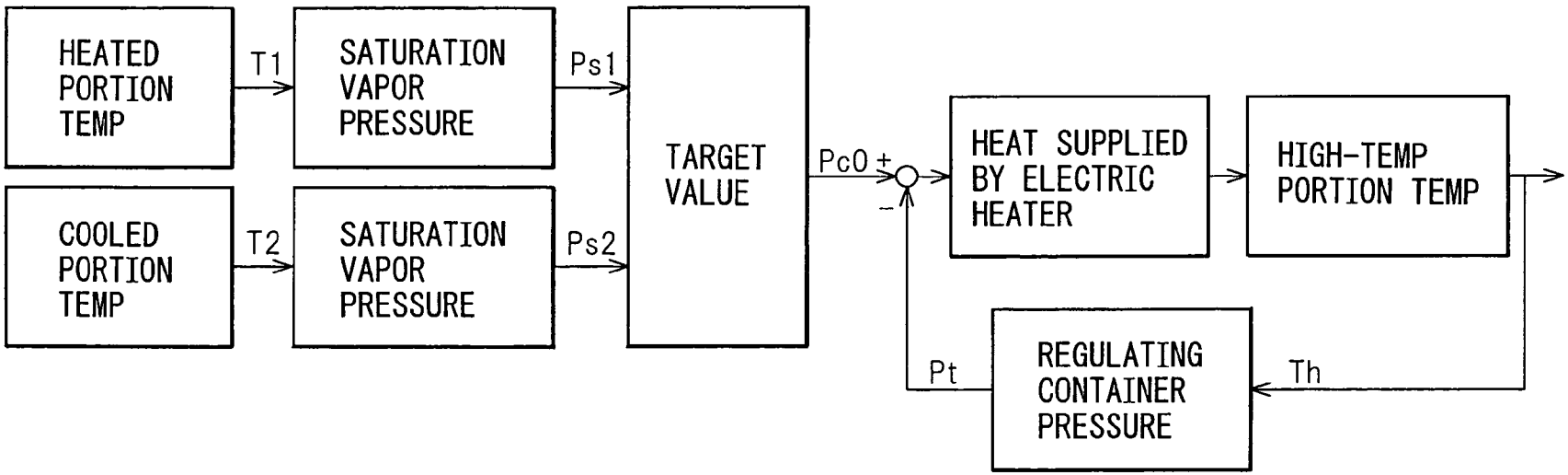
FIG. 18 is a block diagram schematically showing the control operation according to the sixth embodiment of the invention.

FIG. 18 is a block diagram schematically showing the operation of controlling the in-container pressure Pc according to this embodiment. In this embodiment, the saturation vapor pressure of the pressure regulating liquid 18 at the high-temperature portion temperature Th is calculated based on the high-temperature portion temperature Th and the vapor pressure curve of the pressure regulating liquid 18 (FIG. 7). The regulating container internal pressure Pt can be calculated as it is equal to the saturation vapor pressure of the pressure regulating liquid 18 at the high-temperature portion temperature Th as described in the fifth embodiment above.

According to this embodiment, the high-temperature portion temperature sensor 51 can be arranged outside the pressure regulating container 16 and, unlike in the fifth embodiment described above, the regulating container internal pressure sensor 23 is not required to be inserted into the pressure regulating container 16. Therefore, the inconvenience of the pressure regulating liquid 18 leaking from the pressure regulating container 16 through the regulating container internal pressure sensor 23 is avoided.

The vapor 50 in the high temperature portion 48 may be either the pure vapor of the pressure regulating liquid 18 or a mixture of the vapor of the pressure regulating liquid 18 and another gas (such as air). Also, as in the first and second embodiments, the gas 100 may be sealed in the pressure regulating container 16.

Seventh Embodiment

In the sixth embodiment described above, the high-temperature portion temperature Th is detected directly by the high-temperature portion temperature sensor 51. According to the seventh embodiment, on the other hand, the high-temperature portion temperature sensor 51 is eliminated, and the high-temperature portion temperature Th is calculated based on the electric energy Q2 input to the electric heater 46*a*.

Figure 19:
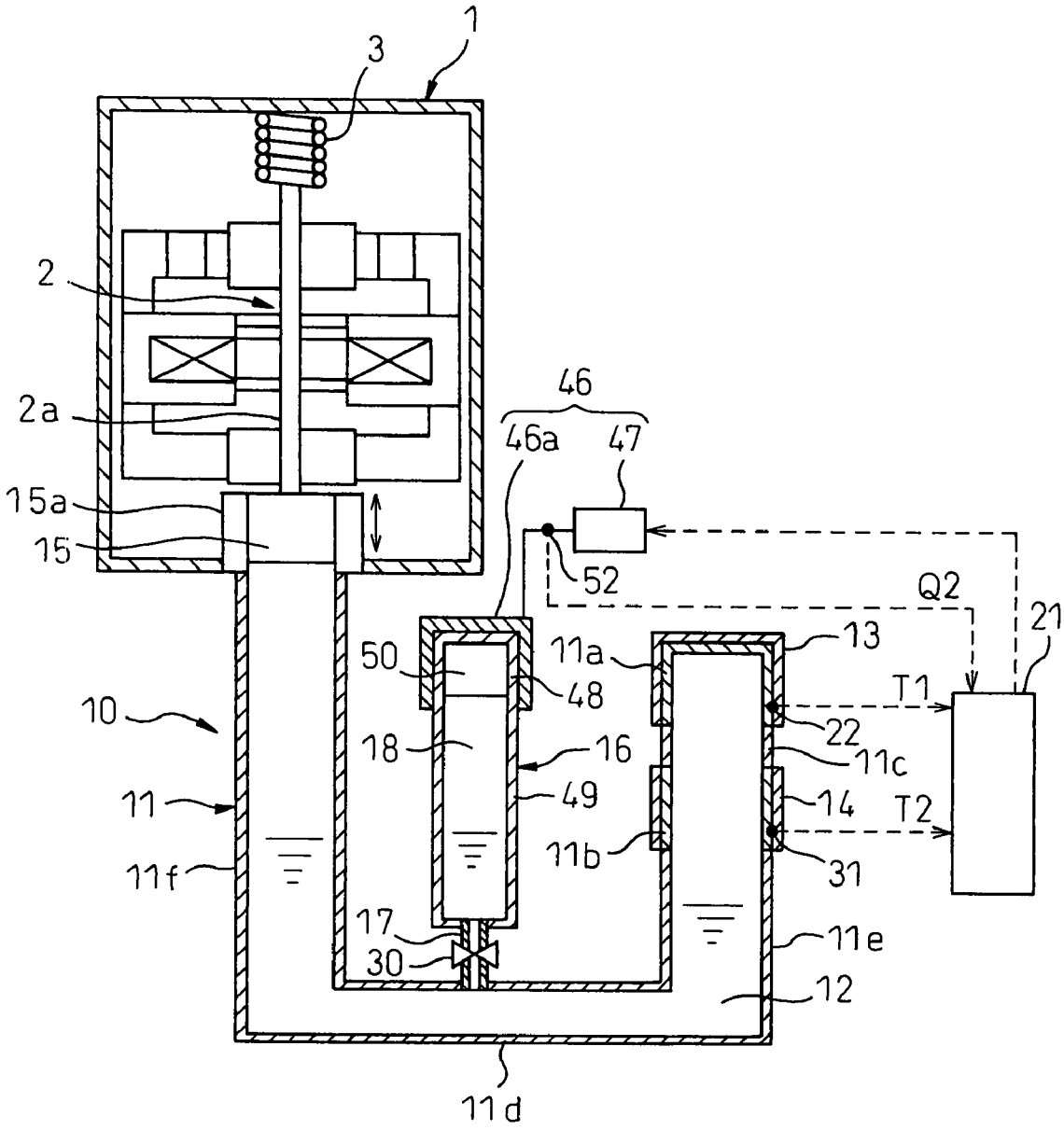
FIG. 19 is a diagram showing a general configuration of a power-generating system according to a seventh embodiment of the invention.

FIG. 19 is a diagram showing a general configuration of the power generating system according to this embodiment. According to this embodiment, the detection signal from an electric energy sensor 52 for detecting the electric energy Q2 input to the electric heater 46*a* is input to the control unit 21 to calculate the regulating container internal pressure Pt.

As is well known, the high-temperature portion temperature Th is calculated by Equation (1) below.

$$Th=Q1/(m\cdot Cp)-T0 \quad (1)$$

where Q1 is the amount of heat (kJ) applied from the electric heater 46*a* to the pressure regulating liquid 18, m the mass (kg) of the pressure regulating container 16, Cp the specific heat (kJ/kg·K) of the pressure regulating container 16, and T0 the temperature (K) of the pressure regulating container 16 yet to be heated by the electric heater 46*a*.

According to this embodiment, the amount of heat Q1 applied from the electric heater 46*a* to the pressure regulating liquid 18 is substantially equal to the electric energy Q2 input to the electric heater 46*a*, and the temperature T0 of the pressure regulating container 16 yet to be heated by the electric heater 46*a* is substantially equal to the cooled portion temperature T2. According to this embodiment, therefore, the high-temperature portion temperature Th is calculated, in Equation (1), using the electric energy Q2 input to the electric heater 46*a* instead of the amount of heat Q1 applied from the electric heater 46*a* to the pressure regulating liquid 18 and also using the cooled portion temperature T2 instead of the temperature T0 of the pressure regulating container 16 yet to be heated by the electric heater 46*a*.

According to this embodiment, the electric energy sensor 52 can be located at a distance from the high temperature portion 48 and, unlike in the seventh embodiment described above, the high-temperature portion temperature sensor 51 is not required to be located in the high temperature portion 48. For this reason, the inconvenience of damaging the sensor with the heat of the high-temperature portion 48 can be avoided.

According to this embodiment, the high-temperature portion temperature Th is calculated by Equation (1). Nevertheless, the high-temperature portion temperature Th can alternatively be calculated by correcting Equation (1) using an appropriate coefficient.

Also, according to this embodiment, the cooled portion temperature T2 is used in place of the temperature T0 of the pressure regulating container 16 yet to be heated by the electric heater 46*a*. Nevertheless, the cooling portion temperature T2 is not necessarily used. For example, the temperature T0 of the pressure regulating container 16 yet to be heated by the electric heater 46*a* can be replaced by the temperature of the portion of the container 11 other than the heated portion 11*a* and the cooled portion 11*b*, the temperature of the atmosphere in the neighborhood of the pressure regulating container 16 or a temperature approximate to the temperature T0 of the pressure regulating container 16 yet to be heated by the electric heater 46*a*.

The vapor 50 in the high temperature portion 48 may be either the pure vapor of the pressure regulating liquid 18 or a mixture of the vapor of the pressure regulating liquid 18 and another gas (such as air). Also, as in the first and second embodiments described above, the gas 100 may be sealed in the pressure regulating container 16.

Eighth Embodiment

In the seventh embodiment described above, the pressure regulating liquid 18 in the pressure regulating container 16 is vaporized by the electric heater 46*a*. According to the eighth embodiment, on the other hand, as shown in FIG. 20, the pressure regulating liquid 18 in the pressure regulating container 16 is vaporized with a high temperature gas as a heat source.

Figure 20:
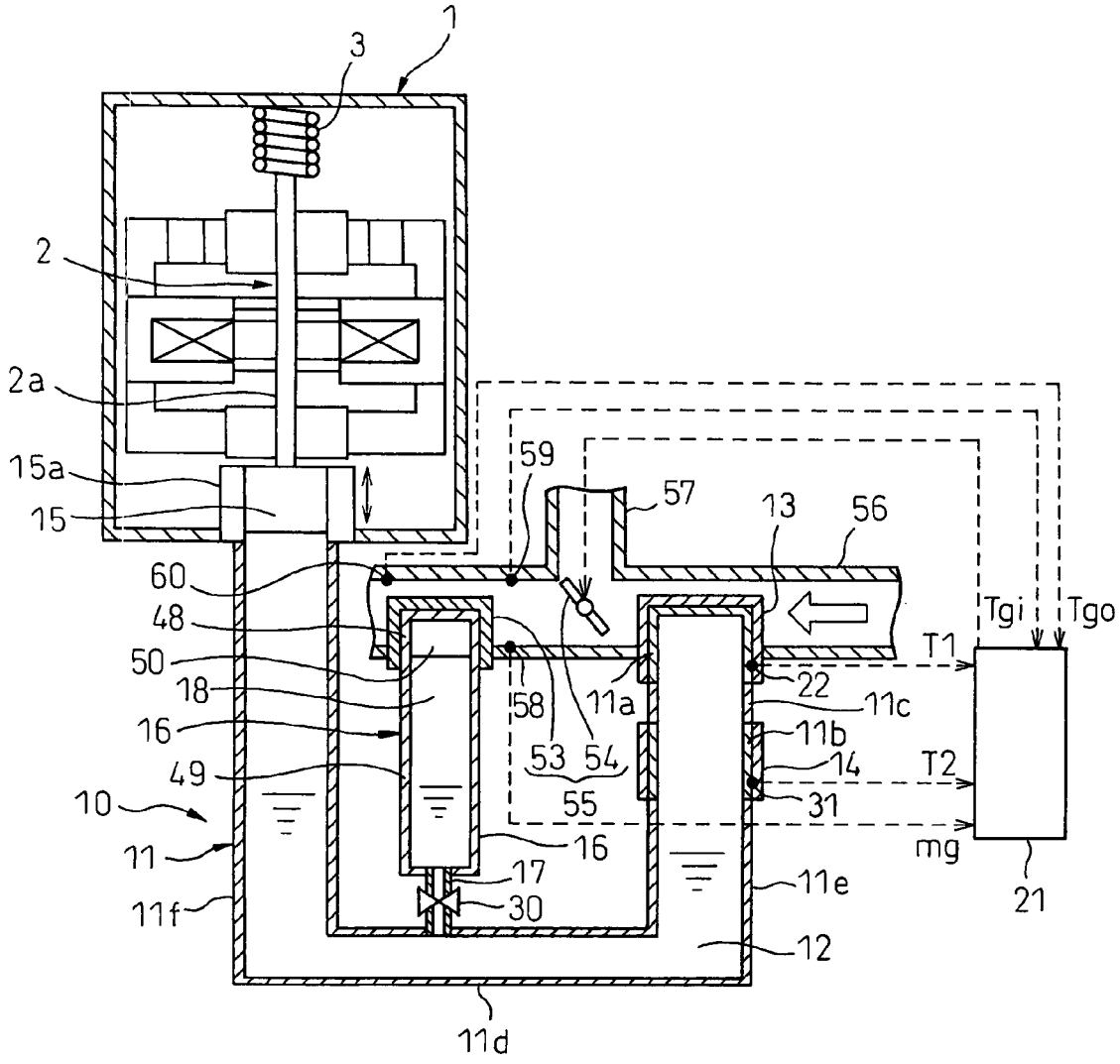
FIG. 20 is a diagram showing a general configuration of a power generating system according to an eighth embodiment of the invention.

FIG. 20 is a diagram showing a general configuration of the power generating system according to this embodiment. According to this embodiment, unlike in the seventh embodiment, a heating means 55 including a pressure regulating heater 53 and a regulation valve 54*d* is used in place of the heating means 46 including the electric heater 46*a* and the electric energy sensor 52. Incidentally, the regulation valve 54 corresponds to the flow rate regulation means according to the invention.

The pressure regulating heater 53 for heating the pressure regulating container 16 by heat exchange with the high temperature gas is disposed at the end (upper end in FIG. 20) of the pressure regulating container 16 far from the connecting pipe 17. The portion of the pressure regulating container 16 which is in contact with the pressure regulating heater 53, therefore, is preferably formed of a material high in heat conductivity.

According to this embodiment, the pressure regulating heater 53 is heated by the high temperature gas after heating the heater 13. More specifically, the heater 13 is inserted upstream of the high-temperature gas pipe 56 and the pressure regulating heater 53 downstream thereof. The high-temperature gas pipe 56 includes a bypass pipe 57 branching from the intermediate part between the heater 13 and the pressure regulating heater 53.

A regulation valve 54 for regulating the ratio of flow rate between the high temperature gas flowing in the pressure regulating container 53 and the high temperature gas flowing in the bypass pipe 57 is disposed at the diverging point of the bypass pipe 57 branching from the high-temperature gas pipe 56. The opening degree of the regulation valve 54 is controlled by the control unit 21.

Also, according to this embodiment, in order to calculate the regulating container internal pressure Pt, the control unit 21 is supplied with the detection signals from a flow rate sensor 58 for detecting the high-temperature gas flow rate (mass flow rate) mg in the pressure regulating heater 53, a pre-heating gas temperature sensor 59 for detecting the high-temperature gas temperature Tgi before heating the pressure regulating container 16 and a post-heating gas temperature sensor 60 for detecting the high-temperature gas temperature Tgo after heating the pressure regulating container 16.

According to this embodiment, the amount of heat of the high temperature gas, remaining after being partially consumed as a heat source of the heater 13, is used as a heat source of the pressure regulating heater 53. The amount of heat Q3 applied from the high temperature gas to the pressure regulating container 16, therefore, corresponds to the amount of heat Q1 applied from the electric heater 46*a* to the pressure regulating liquid 18 in the seventh embodiment described above.

As well known, the amount of heat Q3 applied from the high temperature gas to the pressure regulating container 16 is calculated by Equation (2) and the high-temperature portion temperature Th by Equation (3) below.

$$Q3=mg\cdot Cgp\cdot(Tgi-Tgo) \tag{2}$$

$$Th=Q3/(m-Cp)-T0 \tag{3}$$

where Cgp is the specific heat (kJ/kg·K) of the high temperature gas. Also, as in the seventh embodiment described above, the high-temperature portion temperature Th is calculated by using the cooled portion temperature T2 in place of the temperature T0 of the pressure regulating container 16 yet to be heated by the electric heater 46*a*.

Figure 21:
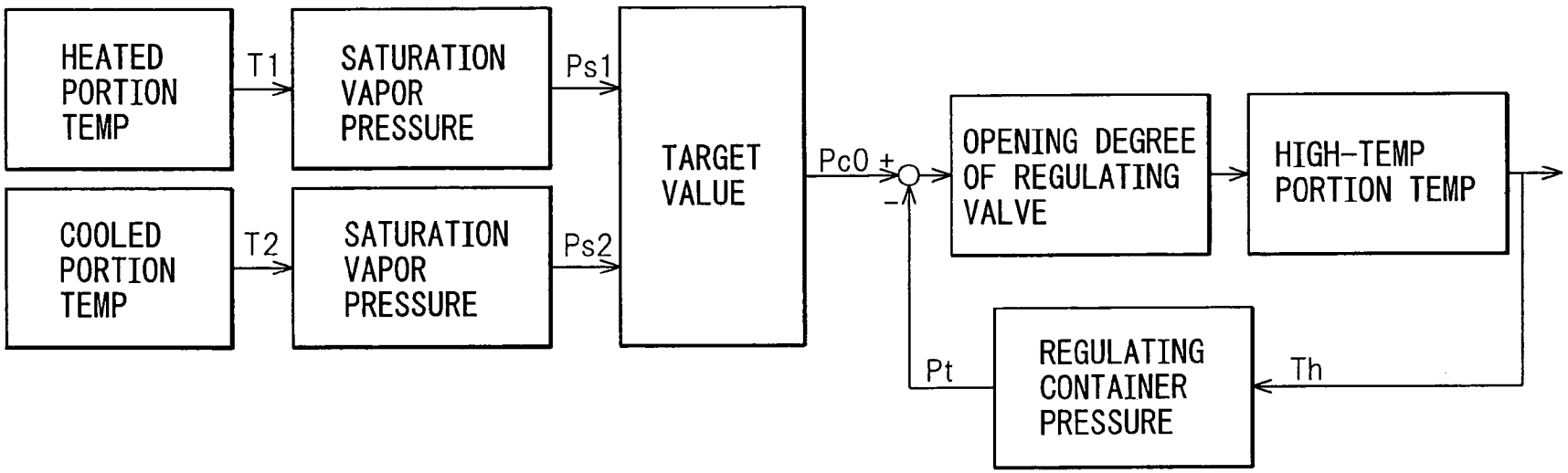
FIG. 21 is a block diagram schematically showing the control operation according to the eighth embodiment of the invention.

FIG. 21 is a block diagram schematically showing the operation of controlling the in-container pressure Pc according to this embodiment. In this embodiment, the regulating container internal pressure Pt is calculated by calculating the saturation vapor pressure of the pressure regulating liquid 18 at the high-temperature portion temperature Th based on the high-temperature portion temperature Th of the pressure regulating container 16 calculated by Equations (2), (3) and the vapor pressure curve of the working liquid 12 shown in FIG. 7.

In the case where the regulating container internal pressure Pt is lower than the target value Pc0, the opening degree of the regulation valve 54 is increased thereby to increase the flow rate mg of the high temperature gas in the pressure regulating heater 53. As a result, the high-temperature portion temperature Th of the pressure regulating container 16 increases and so does the regulating container internal pressure Pt.

In the case where the regulating container internal pressure Pt is higher than the target value Pc0, on the other hand, the opening degree of the regulation valve 54 is decreased thereby to decrease the flow rate mg of the high temperature gas in the pressure regulating heater 53. As a result, the high-temperature portion temperature Th of the pressure regulating container 16 decreases and so does the regulating container internal pressure Pt.

Then, as in the fifth to seventh embodiments, the average value Pca of the in-container pressure Pc approaches the target value Pc0. As a result, the operating condition of the external combustion engine 10 can always be approximated to the ideal state, and therefore the reduction in the performance (output and efficiency) of the external combustion engine 10 which otherwise might be caused by the change in the saturation vapor pressure Ps1 or the change in the peak value Pc1 of the in-container pressure Pc is prevented.

According to this embodiment, the residual amount of heat of the high temperature gas constituting the heat source of the heater 13 can be used as a heat source for vaporizing the pressure regulating liquid 18 in the pressure regulating container 16. As a result, the exhaust heat can be utilized effectively and therefore the energy efficiency of the external combustion engine 10 as a whole can be improved.

Also, the amount of heat Q3 applied from the high temperature gas to the pressure regulating container 16 and the high-temperature portion temperature Th, which is calculated by Equations (2), (3) according to this embodiment, may alternatively be calculated from the high temperature gas by correcting Equations (2), (3) using an appropriate coefficient.

Also, the high-temperature portion temperature Th, though calculated from the flow rate, temperature, etc. of the high-temperature gas according to this embodiment, may alternatively be detected directly by the high-temperature portion temperature sensor 51 as in the sixth embodiment described above.

Also, the regulating container internal pressure Pt, though calculated based on the high-temperature portion temperature Th according to this embodiment, may alternatively be detected directly by the regulating container internal pressure sensor 23 as in the fifth embodiment described above.

Also, according to this embodiment, the cooled portion temperature T2 is used in place of the temperature T0 of the pressure regulating container 16 yet to be heated by the electric heater 46*a*. However, the cooled portion temperature T2 is not necessarily used. For example, a temperature approximate to the temperature T0 of the pressure regulating container 16 yet to be heated by the electric heater 46*a* including the temperature of the portion of the container 11 other than the heated portion 11*a* or the atmospheric temperature in the neighborhood of the pressure regulating container 16 can be used in place of the temperature T0 of the pressure regulating container 16 yet to be heated by the electric heater 46*a*.

Incidentally, the vapor 50 in the high temperature portion 48 may be either the pure vapor of the pressure regulating liquid 18 or a mixture of the vapor of the pressure regulating liquid 18 and another gas (such as air). Also, as in the first and second embodiments, the gas 100 may be sealed in the pressure regulating container 16.

Ninth Embodiment

In the second to eighth embodiments, the regulating container internal pressure Pt is approximated to the ideal average value Pci (FIG. 3A) by use of various sensors or the control unit 21. According to the ninth embodiment, on the other hand, the regulating container internal pressure Pt is approximated to the ideal average value Pci without using the sensors or the control unit 21.

Figure 22:
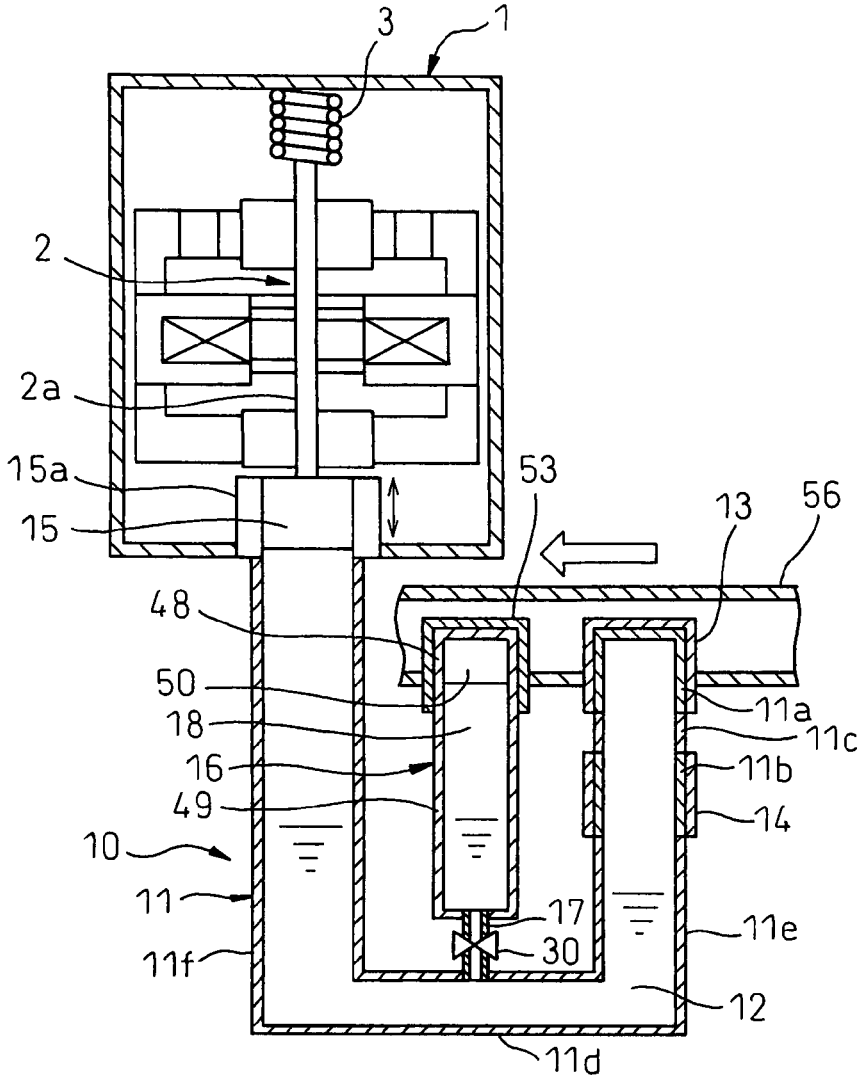
FIG. 22 is a diagram showing a general configuration of a power generating system according to a ninth embodiment of the invention.

FIG. 22 is a diagram showing a general configuration of the power generating system according to this embodiment. According to this embodiment, as compared with the eighth embodiment described above, the control unit 21, the heated-portion temperature sensor 22, the cooled-portion temperature sensor 31, the regulation valve 54, the bypass pipe 57, the flow rate sensor 58, the pre-heating gas temperature sensor 59 and the post-heating gas temperature sensor 60 are eliminated.

Figure 23:
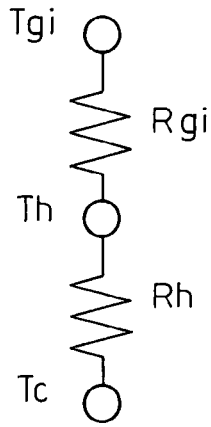
FIG. 23 is a model diagram showing the thermal resistance of the pressure regulating container according to the ninth embodiment of the invention.

FIG. 23 shows a model of thermal resistance in the pressure regulating container 16 according to this embodiment. In FIG. 23, reference character Tgi designates a high-temperature gas temperature before heating the pressure regulating container 16 as described in the eighth embodiment, character Th the high-temperature portion temperature described in the fifth embodiment, character Tc the low-temperature portion temperature described in the fifth embodiment, character Rgi the thermal resistance between the high temperature gas before heating the pressure regulating container 16 and the high temperature portion 48 of the pressure regulating container 16, and character Rh the thermal resistance between the high temperature portion 48 and the lower end of the low temperature portion 49 (the outlet of the pressure regulating container 16) of the pressure regulating container 16.

As understood from FIG. 23, the pressure regulating container 16 has a structure with such a thermal resistance that once it is heated by the high temperature gas, the high-temperature portion temperature Th is always lower than the high-temperature gas temperature Tgi before heating the pressure regulating container 16 and higher than the low-temperature portion temperature Tc ($Tc<Th<Tgi$).

Further, as described in the seventh embodiment, the pressure regulating heater 53 is located downstream of the heater 13 in the high temperature gas flow, and therefore the high-temperature portion temperature Th is always lower than the heated-portion temperature T1. Also, as described in the fifth embodiment, the low-temperature portion temperature Tc is slightly higher than the cooled-portion temperature T2, and therefore the high-temperature portion temperature Th is always lower than the heated-portion temperature T1 and higher than the cooled-portion temperature T2 ($T2<Th<T1$).

Assume that the ideal temperature T1 is that of the pressure regulating liquid 18 in the case where the saturation vapor pressure of the pressure regulating liquid 18 is equal to the ideal average value Pci. By setting the thermal resistance Rgi and the thermal resistance Rh in such a manner that the high-temperature portion temperature Th is substantially equal to the ideal temperature Ti, the regulating container internal pressure Pt always becomes substantially equal to the ideal average value Pci.

Then, as in the second to eighth embodiments described above, the average value Pca of the in-container pressure Pc approaches the ideal average value Pci. As a result, the operating condition of the external combustion engine 10 can always be approximated to the ideal state, and therefore the reduction in the performance (output and efficiency) of the external combustion engine 10 which otherwise might be caused by the change in the saturation vapor pressure Ps1 or the change in the peak value Pc1 of the in-container pressure Pc is prevented.

According to this embodiment, the in-container pressure Pc can be approximated to the ideal average value Pci without using the control unit 21 and the various sensors, and therefore, the structure of the external combustion engine 10 can be simplified, resulting in a lower cost thereof.

Incidentally, according to this embodiment, the pressure regulating heater 53 is located downstream of the heater 13 in the high temperature gas flow. Nevertheless, the invention is not necessarily limited to this arrangement, and as long as the pressure regulating container 16 is so constructed as to have the thermal resistance as described above, the pressure regulating heater 53 may be located upstream of the heater 13 in the high temperature gas flow.

Also, the vapor 50 in the high temperature portion 48 may be either the pure vapor of the pressure regulating liquid 18 or a mixture of the vapor of the pressure regulating liquid 18 and another gas (such as air). Further, as in the first and second embodiments described above, the gas 100 may be sealed in the pressure regulating container 16.

Tenth Embodiment

According to the ninth embodiment described above, the pressure regulating container 16 is heated by the high temperature gas. In the tenth embodiment, however, as shown in FIG. 24, the pressure regulating container 16 is heated by heat conduction from the heater 13.

Figure 24:
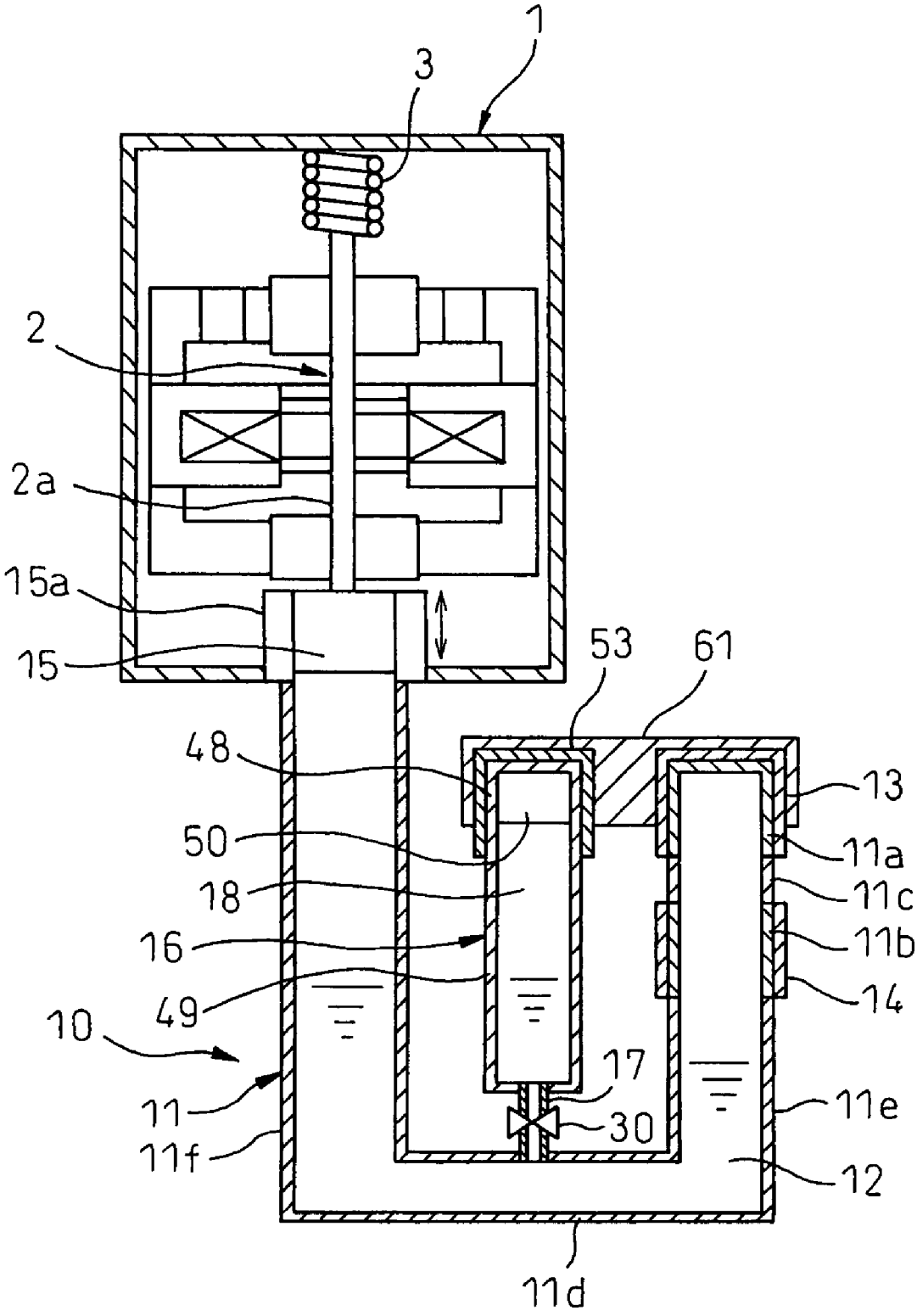
FIG. 24 is a diagram showing a general configuration of a power generating system according to a tenth embodiment of the invention.

FIG. 24 is a diagram showing a general configuration of the power generating system according to this embodiment. The pressure regulating container 16 according to this embodiment has a structure with a similar thermal resistance to that of the ninth embodiment. Also, according to this embodiment, a high-temperature heat conduction member 61 is arranged to transmit the heat of the heater 13 to the pressure regulating heater 53. As a result, the pressure regulating heater 53 has the same heat source as the heater 13.

Also with the configuration described above, a similar effect to the ninth embodiment can be obtained.

Incidentally, the vapor 50 in the high temperature portion 48 may be either the pure vapor of the pressure regulating liquid 18 or a mixture of the vapor of the pressure regulating liquid 18 and another gas (such as air). Also, as in the first and second embodiments, the gas 100 may be sealed in the pressure regulating container 16.

11th Embodiment

Figure 25:
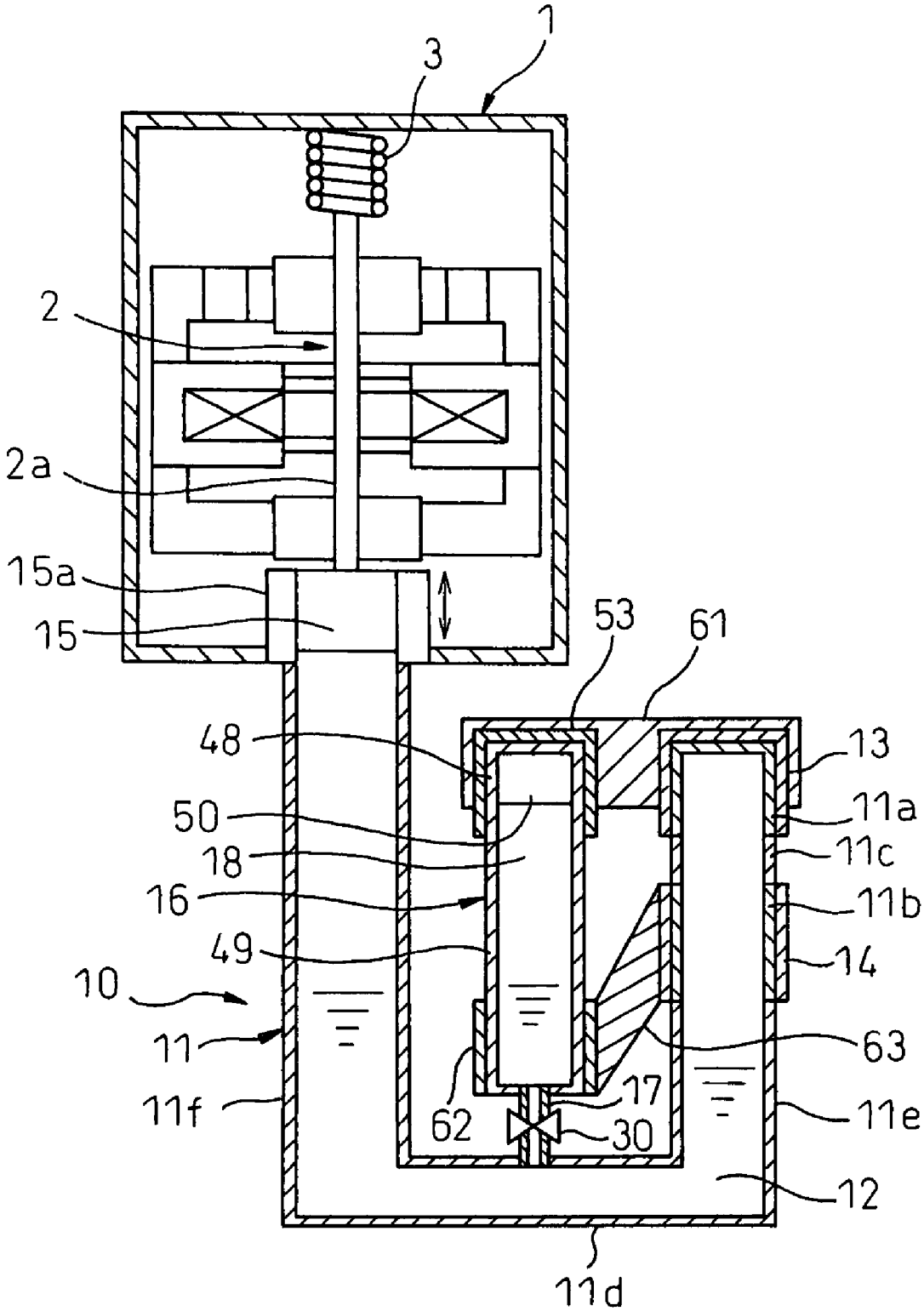
FIG. 25 is a diagram showing a general configuration of a power generating system according to an 11th embodiment of the invention.

Unlike in the tenth embodiment in which the low-temperature portion temperature Tc is slightly higher than the cooled-portion temperature T2, the 11th embodiment is such that as shown in FIG. 25, the low-temperature portion temperature Tc is approximated more closely to the cooled-portion temperature T2.

FIG. 25 is a diagram showing a general configuration of the power generating system according to this embodiment. In this embodiment, a pressure regulating cooler 62 is disposed at the end of the pressure regulating container 16 nearer to the connecting pipe 17 (lower end in FIG. 20). Also, a low-temperature heat conduction member 63 is arranged to transmit heat from the pressure regulating cooler 62 to the cooled portion 11*b*.

As a result, the outlet (lower end of the low temperature portion 49) of the pressure regulating container 16 is cooled by the cooling water circulating in the cooler 14. Thus, the portion of the pressure regulating container 16 which is in contact with the pressure regulating cooler 62 is preferably formed of a material high in heat conductivity.

According to this embodiment, the outlet (lower end of the low temperature portion 49) of the pressure regulating container 16 is cooled to a temperature almost equal to the temperature of the cooled-portion temperature T2, and therefore the low-temperature portion temperature Tc can be positively maintained at a level not higher than the boiling point of the pressure regulating liquid 18.

In view of the fact that the liquid level of the pressure regulating liquid 18 can be located positively in the high temperature portion 48, the pressure regulating liquid 18 can be positively kept in contact with the high temperature portion 48, thereby making it possible to maintain the pressure regulating container 16 positively in the boiling state. As a result, the regulating container internal pressure Pt can be positively kept at a level equal to the saturation vapor pressure of the pressure regulating liquid 18 at the high-temperature portion temperature Th.

Incidentally, the vapor 50 in the high temperature portion 48 may be either the pure vapor of the pressure regulating liquid 18 or a mixture of the vapor of the pressure regulating liquid 18 and another gas (such as air). Also, as in the first and second embodiments, the gas 100 may be sealed in the pressure regulating container 16.

12th Embodiment

In the fifth to 11th embodiments described above, the in-container pressure Pc is controlled by vaporizing the pressure regulating liquid 18 in the pressure regulating container 16. According to the 12th embodiment, on the other hand, as shown in FIG. 26, the volume of the pressure regulating container 16 is increased by a volume regulation mechanism 70 upon vaporization of the pressure regulating liquid 18.

Figure 26:
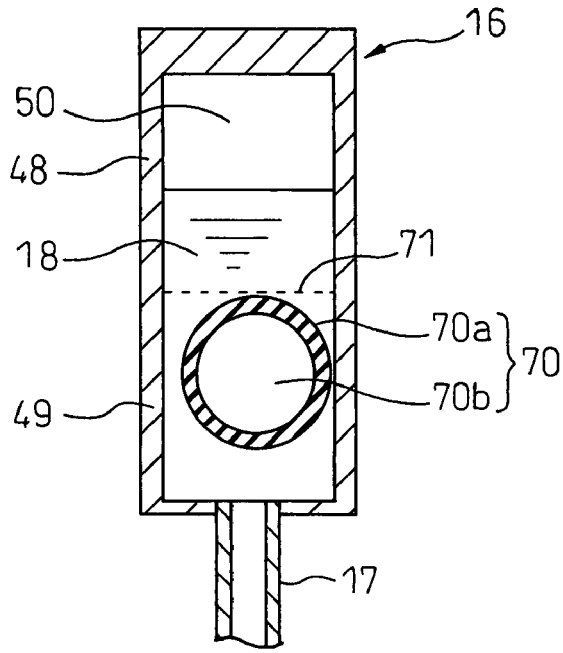
FIG. 26 is an enlarged sectional view showing the pressure regulating container according to a 12th embodiment of the invention.

FIG. 26 is an enlarged sectional view of the pressure regulating container 16 according to this embodiment. According to this embodiment, the pressure regulating container 16 is applicable as the pressure regulating container 16 of the fifth to 11th embodiments. The elastic member 70 making up the volume regulating mechanism is arranged on the low temperature portion 49 side (lower side in FIG. 26) in the pressure regulating container 16. The elastic member 70 consists of a hollow spherical member 70*a* formed of an elastic material such as rubber and a gas (such as air or helium) 70*b* high in compressibility sealed in the hollow spherical member. The elastic member 70 may be formed as a sphere filled up with an elastic material such as rubber.

A mesh member 71 for preventing the elastic member 70 from being displaced toward the high temperature portion 48 is fixedly attached to the inner wall of the pressure regulating container 16 above the elastic member 70 in the pressure regulating container 16.

According to this embodiment, the elastic member 70 is compressed by the volume expansion of the vapor 50 upon vaporization of the pressure regulating liquid 18 in the pressure regulating container 16, and therefore the volume expansion of the vapor 50 can be absorbed. As a result, a space required for vaporizing the pressure regulating liquid 18 can be secured in the pressure regulating container 16, and therefore the vaporization of the pressure regulating liquid 18 by the volume expansion of the vapor 50 is not prevented.

Further, since the volume expansion of the vapor 50 is absorbed into the elastic member 70, the inflow/outflow of the pressure regulating liquid 18 or the working liquid 12 between the pressure regulating container 16 and the container 11 is suppressed. As a result, the great change in the regulating container internal pressure Pt by the inflow/outflow of the pressure regulating liquid 18 can be suppressed, and therefore the operation of the external combustion engine 10 is prevented from being instabilized by the great change in the regulating container internal pressure Pt.

Also, according to this embodiment, the arrangement of the mesh member 71 to prevent the displacement of the elastic member 70 toward the high temperature portion 48 prevents the rubber or the like making up the elastic member 70 from being melted by the heat of the high temperature portion 48.

13th Embodiment

According to the 12th embodiment, the volume regulating mechanism consists of the elastic member 70. In the 13th embodiment, on the other hand, as shown in FIG. 27, the volume regulating mechanism 72 consists of a partitioning plate 72*a* disposed in the pressure regulating container 16 and a gas 72*b* compressed by the partitioning plate 72*a*.

Figure 27:
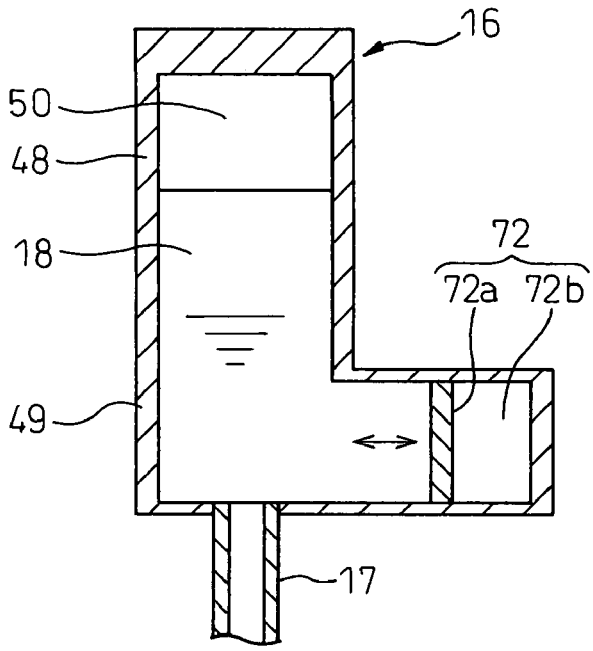
FIG. 27 is an enlarged sectional view showing the pressure regulating container according to a 13th embodiment of the invention.

FIG. 27 is an enlarged sectional view showing the pressure regulating container 16 according to this embodiment. According to this embodiment, as compared with the 12th embodiment, the elastic member 70 and the mesh member 71 are eliminated. In this embodiment, however, the partitioning plate 72*a* is arranged slidably with the inner wall of the pressure regulating container 16 therein. This partitioning plate 72*a* separates the internal space of the pressure regulating container 16 into a space containing the pressure regulating liquid 18 and a space sealed with a gas 73 high in compressibility (such as air or helium).

According to this embodiment, the partitioning plate 72*a* is pressed by the pressure regulating liquid 18 upon vaporization and volume expansion of the pressure regulating liquid 18 in the pressure regulating container 16, so that the partitioning plate 72*a* compresses the gas 72*b* and therefore the volume expansion of the vapor 50 can be absorbed.

As a result, the effects similar to those of the 12th embodiment described above can be produced.

14th Embodiment

According to the 13th embodiment described above, the volume regulating mechanism 72 consists of the partitioning plate 72*a* disposed in the pressure regulating container 16 and the gas 72*b* compressed by the partitioning plate 72*a*. In the 14th embodiment, on the other hand, as shown in FIG. 28, the volume regulating mechanism 73 consists of the partitioning plate 72*a* disposed in the pressure regulating container 16 and an elastic member 74 compressed by the partitioning plate 72*a*.

Figure 28:
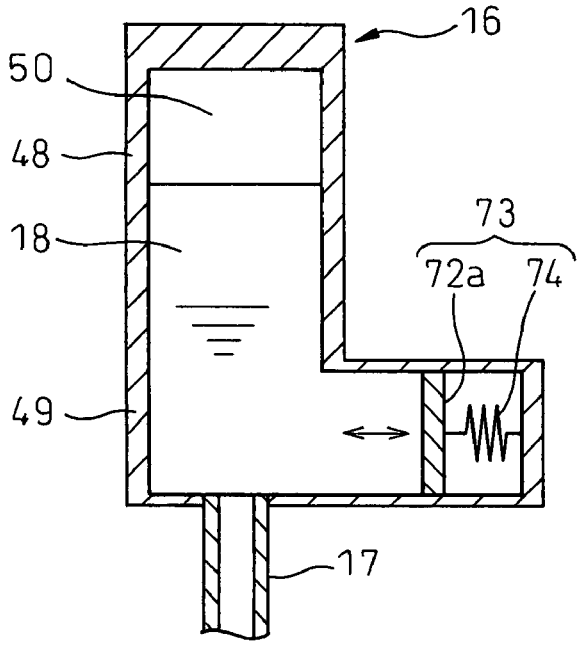
FIG. 28 is an enlarged sectional view showing the pressure regulating container according to a 14th embodiment of the invention.

FIG. 28 is an enlarged sectional view showing the pressure regulating container 16 according to this embodiment. In this embodiment, the elastic member 74 is disposed in that portion of the internal space of the pressure regulating container 16 partitioned by the partitioning plate 72*a* which is far from the space containing the pressure regulating liquid 18, i.e. the space sealed with the gas 72*b* in the 13th embodiment.

The pressure regulating liquid 18, upon vaporization and volume expansion thereof in the pressure regulating container 16, presses the partitioning plate 72*a*, which in turn compresses the elastic member 74, and therefore the volume expansion of the vapor 50 is absorbed As a result, the effects similar to those of the 13th embodiment are produced.

15th Embodiment

In the 12th to 14th embodiments, the volume expansion of the vapor 50 due to vaporization is absorbed by the volume regulating mechanism. According to the 15th embodiment, on the other hand, as shown in FIG. 29, the temperature of the pressure regulating liquid 18 is reduced by a temperature regulating mechanism upon vaporization of the pressure regulating liquid 18.

Figure 29:
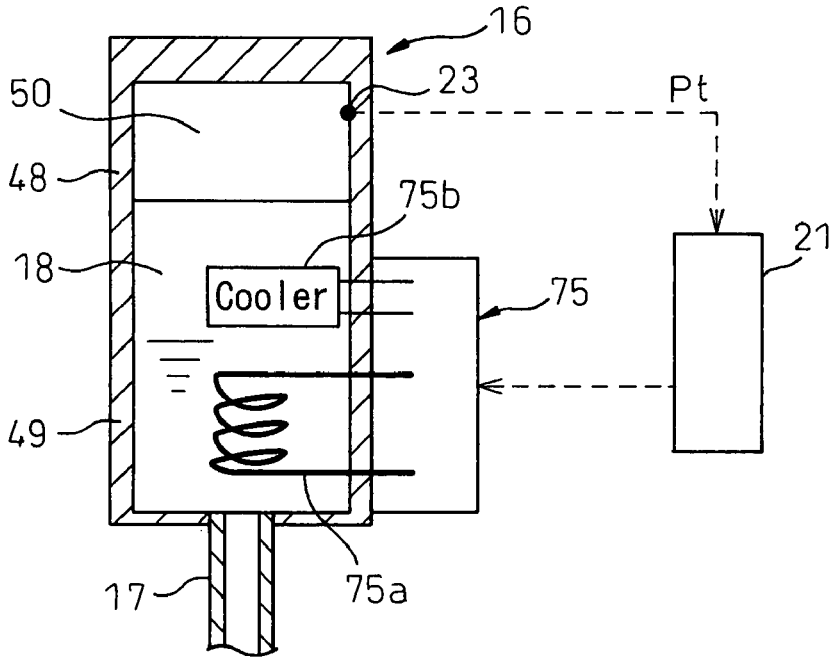
FIG. 29 is an enlarged sectional view showing the pressure regulating container according to a 15th embodiment of the invention.

FIG. 29 is an enlarged sectional view of the pressure regulating container 16 according to this embodiment. In this embodiment, unlike in the 12th embodiment, the elastic member 70 and the mesh member 71 are eliminated. According to this embodiment, however, a temperature controller 75 making up the temperature regulating mechanism is disposed on the low temperature portion 49 side (lower side in FIG. 29) in the pressure regulating container 16.

The temperature controller 75 includes a heater unit 75*a* for heating and thermally expanding the pressure regulating liquid 18 and a cooler unit 75*b* for cooling and thermally contracting the pressure regulating liquid 13. The on/off control operation of the heater unit 75*a* and the cooler unit 75*b* of the temperature controller 75 is performed by the control unit 21 based on the regulating container internal pressure Pt detected by the regulating container internal pressure sensor 23.

According to this embodiment, upon vaporization and volume expansion of the pressure regulating liquid 18 in the pressure regulating container 16, the cooler unit 75*b* is activated and cools the pressure regulating liquid 18. As a result, the pressure regulating liquid 18 is thermally contracted and therefore the volume expansion of the vapor 50 upon vaporization is absorbed.

With the volume reduction of the vapor 50 by liquefaction in the pressure regulating container 16, on the other hand, the heater unit 75*a* is activated and heats the pressure regulating liquid 18. As a result, the pressure regulating liquid 18 is thermally expanded thereby to absorb the volume reduction of the vapor 50 upon liquefaction.

Thus, similar effects to those of the 12th to 14th embodiment are produced.

16th Embodiment

In the second, third and fifth to 15th embodiments described above, the restrictor 30 with a smaller flow path diameter is formed in the connecting pipe 17. According to the 16th embodiment, on the other hand, as shown in FIG. 30, the restrictor 30 is eliminated and a mesh member 76 is disposed in the connecting pipe 17.

Figure 30:
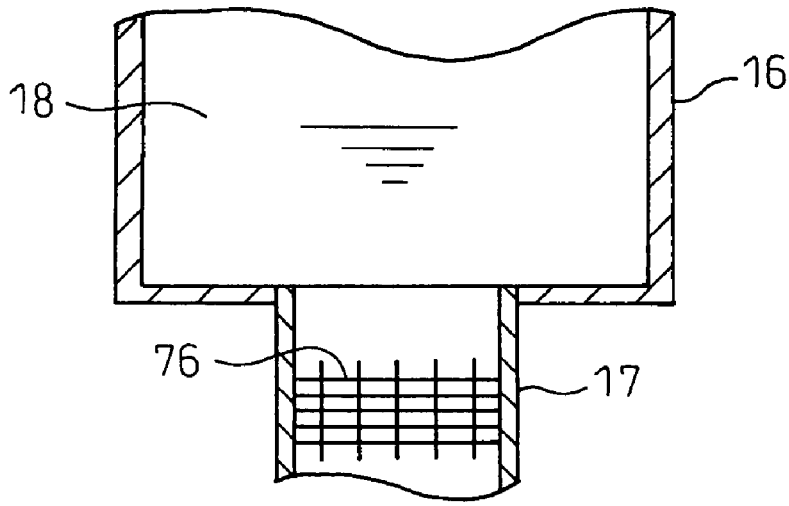
FIG. 30 is an enlarged sectional view showing the connecting pipe portion according to a 16th embodiment of the invention.

FIG. 30 is an enlarged sectional view showing the connecting pipe 17 according to this embodiment. In this embodiment, the mesh member 76 is formed of metal. This mesh member 76 can increase the flow path resistance in the connecting pipe 17, and therefore, as in the case where the restrictor 30 is formed, the propagation of the in-container pressure Pc into the pressure regulating container 16 is suppressed.

17th Embodiment

In the 16th embodiment, the mesh member 76 is disposed in the connecting pipe 17. According to the 17th embodiment, on the other hand, as shown in FIG. 31, the mesh member 76 is eliminated and an orifice 77 is alternatively disposed.

Figure 31:
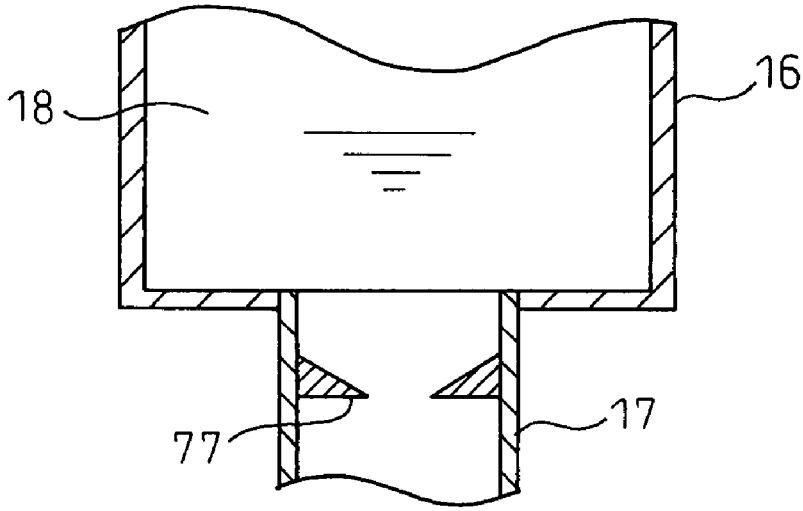
FIG. 31 is an enlarged sectional view showing the connecting pipe portion according to a 17th embodiment of the invention.

FIG. 31 is an enlarged sectional view showing the connecting pipe 17 according to this embodiment. The orifice 77 can increase the flow path resistance in the connecting pipe 17 and therefore similar effects to those of the 16th embodiment are produced.

18th Embodiment

In the second, third and fifth to 17th embodiments described above, the arrangement of the pressure regulating container 16 and the regulation of the regulating container internal pressure Pt prevent the reduction in the performance (output and efficiency) of the external combustion engine 10 which otherwise might be caused by the change in the saturation vapor pressure Ps1 or the change in the peak value Pc1 of the in-container pressure Pc. According to the 18th embodiment, on the other hand, as shown in FIG. 32, the pressure regulating container 16 is eliminated, and by regulating the volume of the container 11, the reduction in the performance (output and efficiency) of the external combustion engine 10 due to the change in the saturation vapor pressure Ps1 or the change in the peak value Pc1 of the in-container pressure Pc is prevented.

Figure 32:
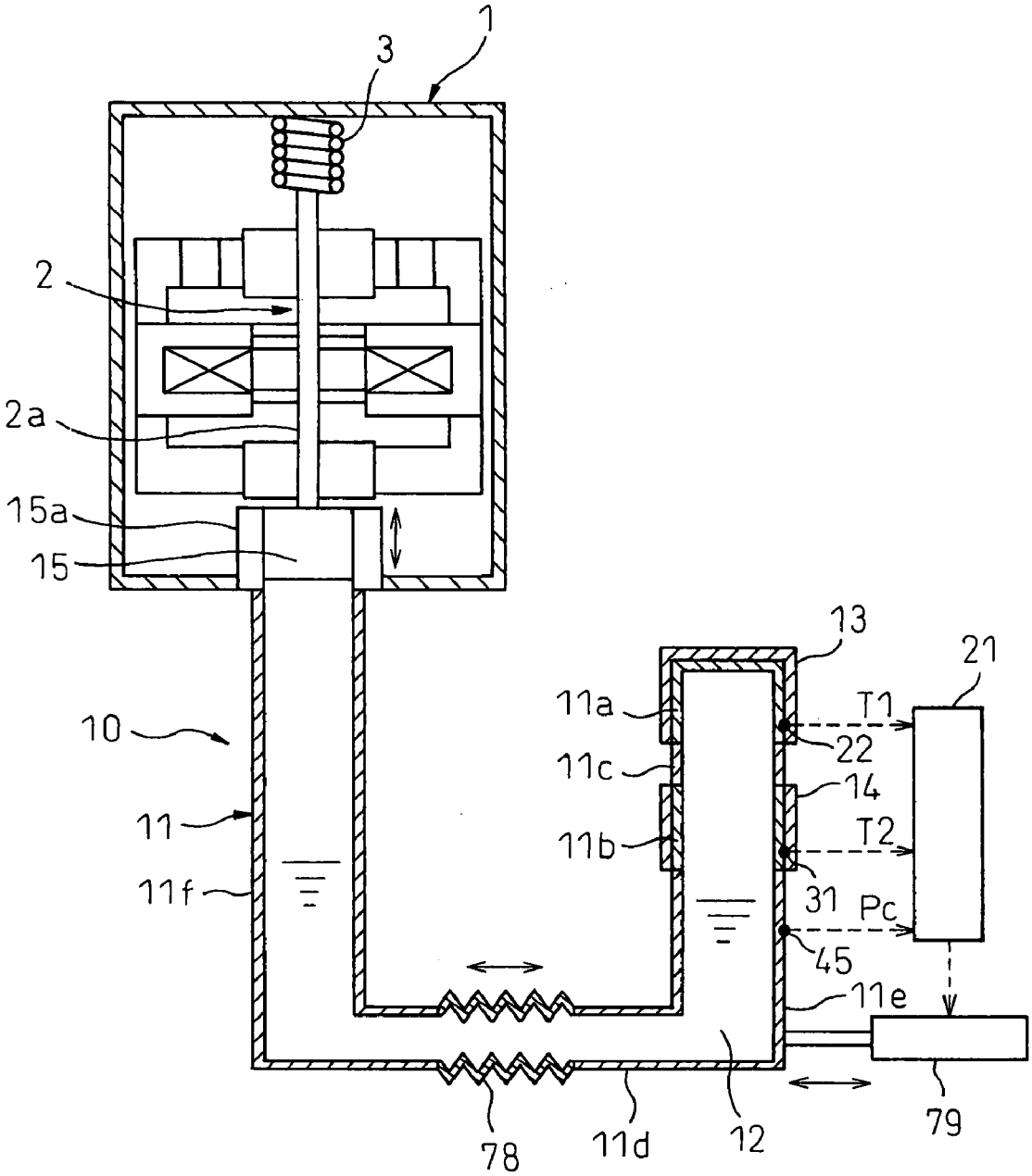
FIG. 32 is a diagram showing a general configuration of a power generating system according to an 18th embodiment of the invention.

FIG. 32 is a diagram showing a general configuration of the power generating system according to this embodiment. According to this embodiment, as compared with the second embodiment described above, the pressure regulating container 16, the connecting pipe 17 and the piston mechanism 19 are eliminated.

According to this embodiment, a bellows-type expansion and contraction portion 78, horizontally extendible, is formed in the bent portion 11*d* of the container 11. An electric actuator 79 for expanding and contracting the expansion and contraction portion 78 is connected to the container 11. The electric actuator 79 corresponds to the extension and contraction drive mechanism according to this invention.

The electric actuator 79 is controlled by the control unit 21 based on the heated-portion temperature T1 detected by the heated-portion temperature sensor 22, the cooled-portion temperature T2 detected by the cooled-portion temperature sensor 31 and the in-container pressure Pc detected by the in-container pressure sensor 45.

Figure 33:
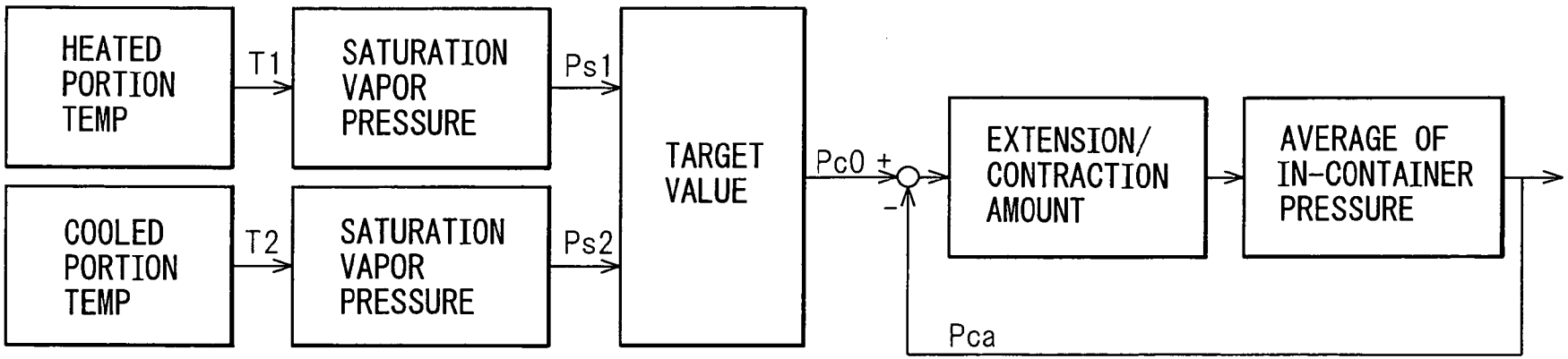
FIG. 33 is a block diagram schematically showing the control operation according to the 18th embodiment of the invention.

FIG. 33 is a block diagram schematically showing the operation of controlling the in-container pressure Pc according to this embodiment. According to this embodiment, in the case where the average value Pca of the in-container pressure Pc is lower than the target value Pc0, the in-container pressure Pc is increased by controlling the electric actuator 79 in such a manner as to shrink the expansion and contraction portion 78.

In the case where the average value Pca of the in-container pressure Pc is higher than the target value Pc0, on the other hand, the in-container pressure Pc is decreased by controlling the electric actuator 79 in such a manner as to extend the expansion and contraction portion 78.

As a result, the average value Pca of the in-container pressure Pc approaches the target value Pc0. Thus, the operating condition of the external combustion engine 10 can always be approximated to the ideal state and therefore the reduction in the performance (output and efficiency) of the external combustion engine 10 which otherwise might be caused by the change in the saturation vapor pressure Ps1 or the change in the peak value Pc1 of the in-container pressure Pc is prevented.

According to this invention, the average value Pca of the in-container pressure Pc is approximated to the target value Pc0. Nevertheless, the peak value Pc1 of the in-container pressure Pc may alternatively be approximated to the saturation vapor pressure Ps1.

19th Embodiment

In the 18th embodiment described above, the reduction in the performance (output and efficiency) of the external combustion engine 10 which otherwise might be caused by the change in the saturation vapor pressure Ps1 or the change in the peak value Pc1 of the in-container pressure Pc is prevented by regulating the volume of the container 11. According to the 19th embodiment, on the other hand, as shown in FIG. 34, the reduction in the performance (output and efficiency) of the external combustion engine 10 which otherwise might be caused by the change in the saturation vapor pressure Ps1 or the change in the peak value Pc1 of the in-container pressure Pc is prevented by regulating the temperature of the working liquid 12.

Figure 34:
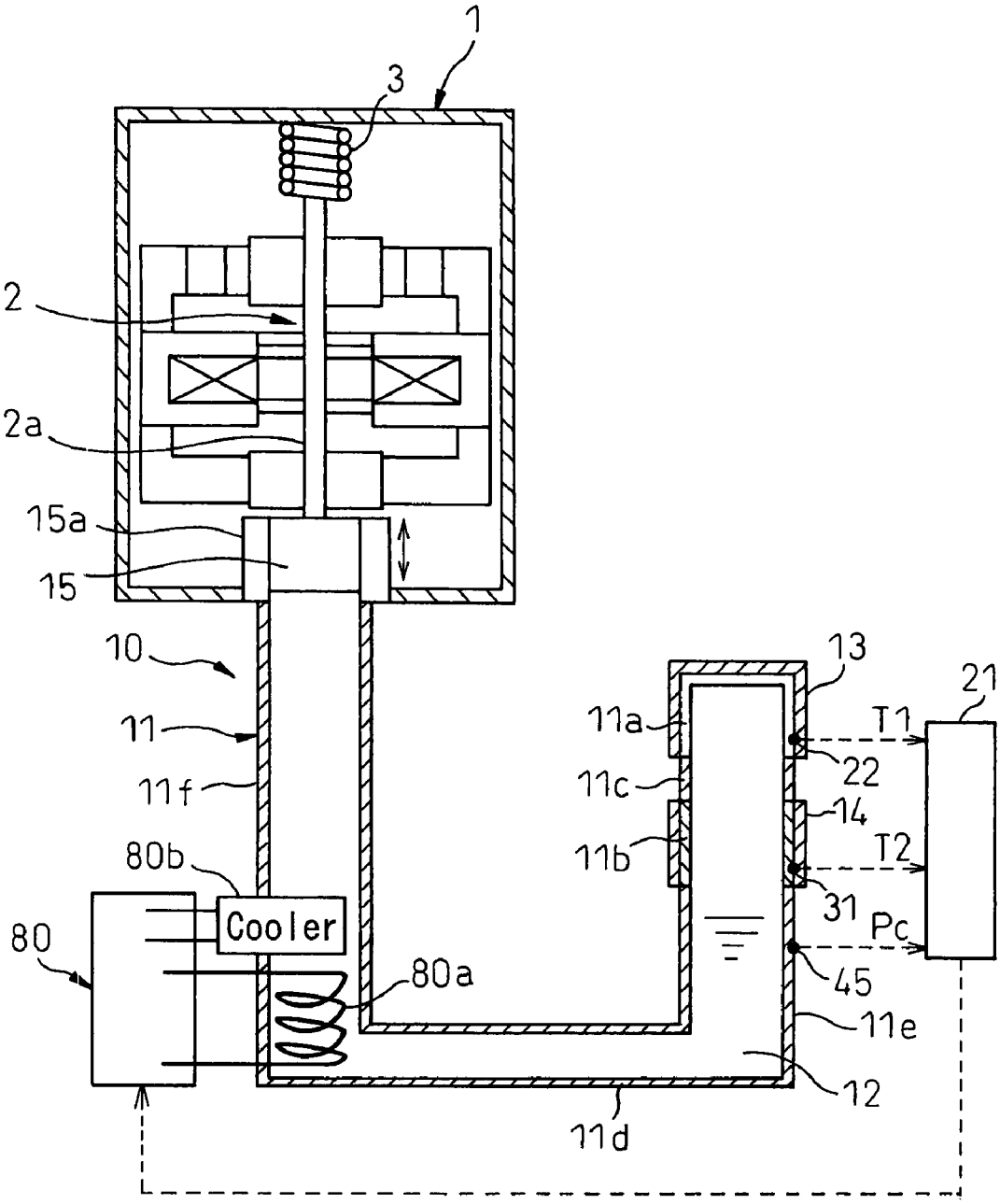
FIG. 34 is a diagram showing a general configuration of a power generating system according to a 19th embodiment of the invention.

FIG. 34 is a diagram showing a general configuration of the power generating system according to this embodiment. According to this embodiment, unlike in the 18th embodiment, the expansion and contraction portion 78, the electric actuator 79 and the cooled-portion temperature sensor 31 are eliminated. Also, according to this embodiment, a temperature controller 80 to maintain a constant temperature of the working liquid 12 is disposed at a portion other than the heated portion 11*a* and the cooled portion 11*b* of the container 11.

The temperature controller 80 includes a heater unit 80*a* for heating the working liquid 12 and a cooler unit 80*b* for cooling the working liquid 12. The on/off control operation of the heater unit 80*a* and the cooler unit 80*b* of the temperature controller 80 is performed by the control unit 21 based on the heated-portion temperature T1 detected by the heated-portion temperature sensor 22 and the in-container pressure Pc detected by the in-container pressure sensor 45.

Figure 35:
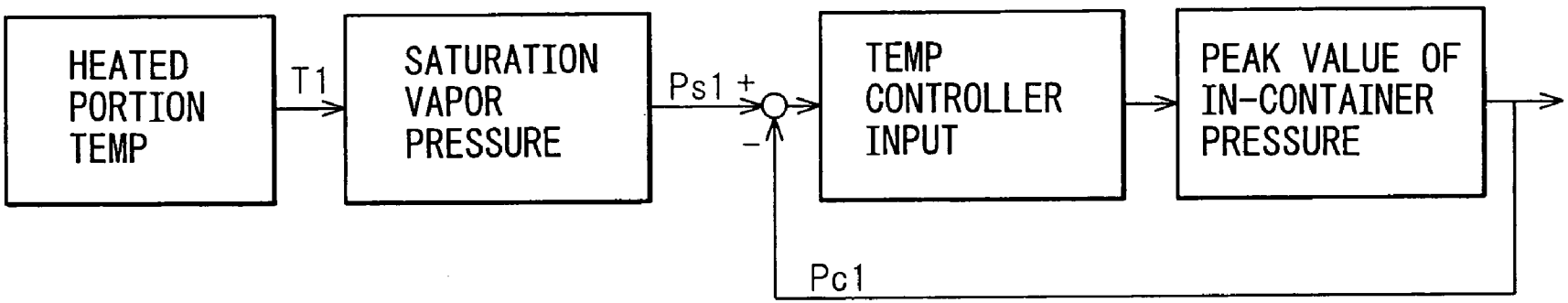
FIG. 35 is a block diagram schematically showing the control operation according to the 19th embodiment of the invention.

FIG. 35 is a block diagram schematically showing the operation of controlling the in-container pressure Pc according to this embodiment. In this embodiment, the saturation vapor pressure Ps1 of the working liquid 12 at the heated-portion temperature T1 is calculated based on the heated-portion temperature T1 and the vapor pressure curve of the working liquid 12 shown in FIG. 7.

In the case where the peak value Pc1 of the in-container pressure Pc is higher than the saturation vapor pressure Ps1, the cooler unit 80*b* is operated to cool the working liquid 12. As a result, the working liquid 12 is thermally contracted, so that the in-container pressure Pc decreases and so does the peak value Pc1 of the in-container pressure Pc.

In the case where the peak value Pc1 of the in-container pressure Pc is lower than the saturation vapor pressure Ps1, on the other hand, the heater unit 80*a* is operated to heat the working liquid 12. As a result, the working liquid 12 is thermally expanded, so that the in-container pressure Pc increases and so does the peak value Pc1 of the in-container pressure Pc.

As a result, the peak value Pc1 of the in-container pressure Pc approaches the saturation vapor pressure Ps1 of the working liquid 12 at the heated-portion temperature T1. Consequently, the operating condition of the external combustion engine 10 can always be approximated to the ideal state, and therefore the reduction in the performance (output and efficiency) of the external combustion engine 10 which otherwise might be caused by the change in the saturation vapor pressure Ps1 or the change in the peak value Pc1 of the in-container pressure Pc is prevented.

20th Embodiment

In each of the embodiments described above, the operating condition of the external combustion engine 10 is always approximated to the ideal state by regulating the in-container pressure Pc. According to the 20th embodiment, on the other hand, the reduction in the performance (output and efficiency) of the external combustion engine 10 which otherwise might be caused by the volume change of the working liquid 12 is suppressed by regulating the volume of the container 11 depending on the temperature change of the working liquid 12 (FIG. 5).

Figure 36:
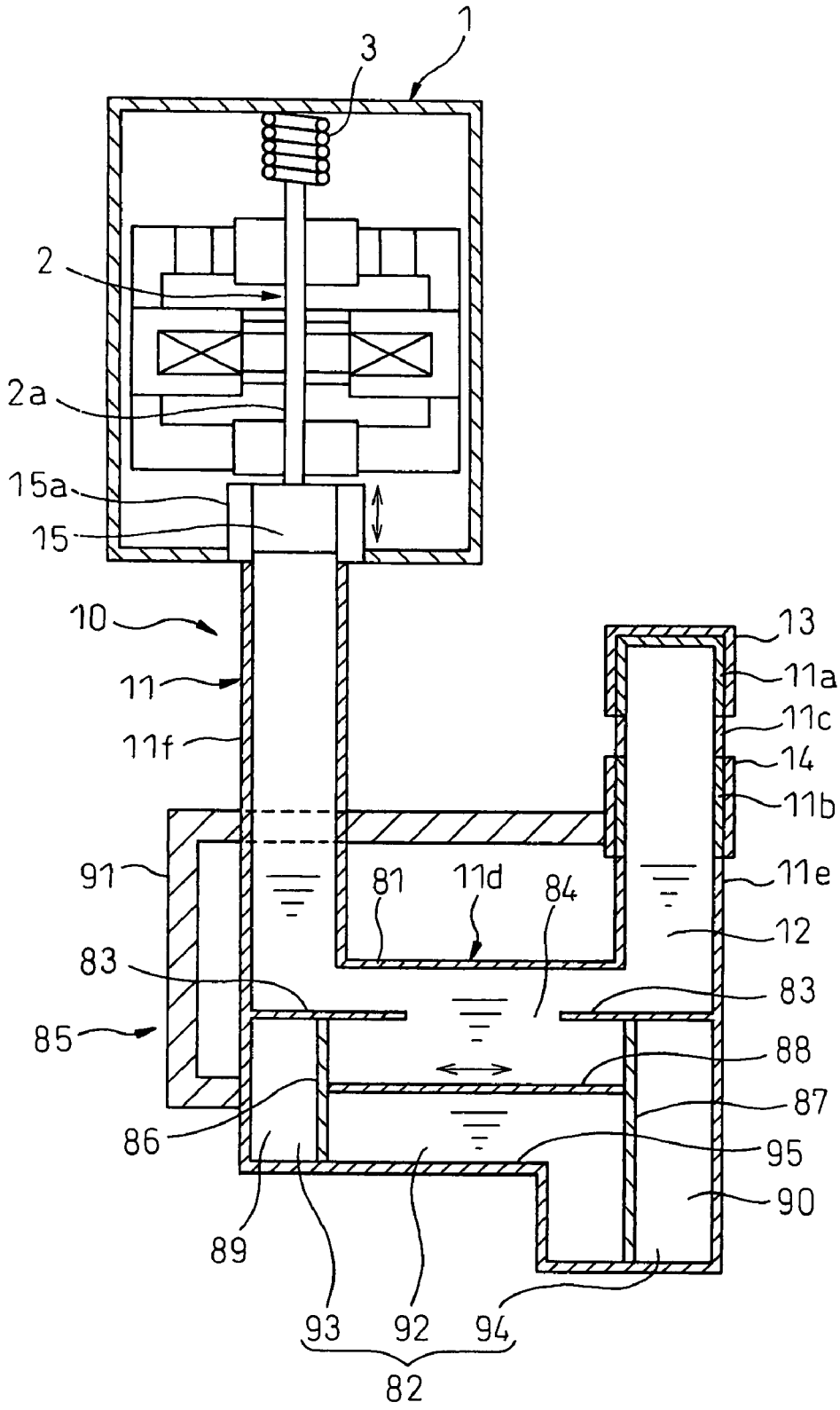
FIG. 36 is a diagram showing a general configuration of a power generating system according to a 20th embodiment of the invention.

FIG. 36 is a diagram showing a general configuration of the power generating system according to this embodiment. In this embodiment, unlike in the 19th embodiment, the temperature controller 80, the control unit 21, the heated-portion temperature sensor 22 and the in-container pressure sensor 45 are eliminated.

According to this embodiment, on the other hand, the internal space of the bent portion 11*d* of the container 11 is divided into a flow space 81 in which the working liquid 12 flows by self-vibration and a container volume regulating space 82 for regulating the volume of the container 11.

More specifically, the flow space 81 is formed on the side of the interior of the bent portion 11*d* nearer to the first and second linear portions 11*e*, 11*f* (upper side in FIG. 34) than a partitioning wall 83 extending horizontally. The container volume regulating space 82, on the other hand, is formed on the side of the interior of the bent portion 11*d* farther from the first and second linear portions lie, 11*f* (lower side in FIG. 34) than the partitioning wall 83. A communicating portion 84 for establishing communication between the flow space 81 and the container volume regulating space 82 is formed at the central part of the partitioning wall 83.

By regulating the volume of the container volume regulating space 82, therefore, the volume of the container 11 can be regulated in its entirety. The volume regulating mechanism 85 for regulating the volume of the container volume regulating space 82 comprises first and second partitioning plates 86, 87, a connecting portion 88, first and second gases 89, 90 and a heat conducting portion 91.

The first partitioning plate 86 and the second partitioning plate 87 are disposed in horizontally opposed relation to each other in the container volume regulating space 82 and connected to each other by the connecting portion 88. The outer peripheral ends of the first and second partitioning plates 86, 87 are adapted to slide integrally with the inner wall and the partitioning wall 83 of the container 11, and the container volume regulating space 82 is separated into three spaces by the first and second partitioning plates 86, 87.

Specifically, the container volume regulating space 82 is divided into a first space 92 between the first partitioning plate 86 and the second partitioning plate 87, a second space 93 on the other side of the first partitioning plate 86 far from the first space 92, and a third space 94 on the other side of the second partitioning plate 87 far from the first space 92.

The wall surface 95 of the container 11 which is faced by the container volume regulating space 82 and extends in the direction (horizontal direction in FIG. 34) at right angles to the first and second partitioning plates 86, 87, is so stepped that the third space 94 side thereof is lower than the second space 93 side thereof. As a result, the sectional areas of the container volume regulating space 82 in a plane parallel to the first and second partitioning plates 86, 87 are such that the sectional area A3 on the third space 94 side is larger than the sectional area A2 on the second space 93 side.

As a result, the volume of the first space 92 is increased thereby to increase the volume of the container 11 as a whole upon the horizontal sliding motion of the first and second partitioning plates 86, 87 toward the third space 94. The horizontal sliding motion of the first and second partitioning plates 86, 87 toward the second space 93, on the other hand, reduces the volume of the first space 92 thereby to decrease the volume of the container 11 as a whole.

In view of the fact that the first space 92 communicates with the flow space 81 through the communicating portion 84, the first space 92 is filled up with the working liquid 12. The second space 93, on the other hand, is sealed with a first gas (such as air or helium) 89 high in compressibility, and the third space 94 with a second gas (such as air or helium) 90 high in compressibility.

The temperature of the first gas 89 in the second space 93 follows the cooled-portion temperature T2 through the heat conducting portion 91. With the increase in the cooled-portion temperature T2, therefore, the first gas 89 also increases in temperature and thermally expands. Then, the first gas 89 presses the first partitioning plate 86 and therefore, the first and second partitioning plates 86, 87 slide horizontally toward the third space 94 so that the second gas 90 is compressed by the second partitioning plate 87. As a result, the volume of the container 11 as a whole is increased.

Conversely, with the decrease in the cooled-portion temperature T2, the first gas 89 also decreases in temperature and thermally contracts. Then, the second gas 90 presses the second partitioning plate 87 and therefore, the first and second partitioning plates 86, 87 slide horizontally toward the second space 93, so that the first gas 89 is compressed by the first partitioning plate 86. As a result, the volume of the container 11 as a whole is decreased.

As shown in FIGS. 4A, 4B and 5, the volume change of the working liquid 12 reduces the performance (output and efficiency) of the external combustion engine 10.

In view of this, according to this embodiment, the volume of the container 11 is regulated depending on the volume change of the working liquid 12 due to the change in the cooled-portion temperature T2. Specifically, with the increase in the cooled-portion temperature T2, the temperature of the working liquid 12 is increased thereby to increase the volume of the working liquid 12 by thermal expansion, while the volume of the container 11 as a whole is increased by the volume regulating mechanism 85.

With the decrease in the cooled-portion temperature T2, on the other hand, the temperature of the working liquid 12 is decreased thereby to decrease the volume of the working liquid 12 by thermal contraction, while the volume of the container 11 as a whole is decreased by the volume regulating mechanism 85.

As a result, the optimum relation is maintained between the volume of the working liquid 12 and the volume of the container 11, and therefore the reduction in the performance (output and efficiency) of the external combustion engine 10 which otherwise might be caused by the volume change of the working liquid 12 is prevented.

The force F3 with which the second gas 90 presses the second partitioning plate 87 is expressed by Equation (4) below, and the maximum value Fmax of the force with which the in-container pressure Pc is exerted on the second partitioning plate 87 by Equation (5) below.

$$F3=A3\cdot P3 \tag{4}$$

$$F\max=\Delta A\cdot P\max \tag{5}$$

where P3 is the pressure exerted by the second gas 90 on the second partitioning plate 87, ΔA the difference between the sectional area A3 of the third space 94 and the sectional area A2 of the second space 93 (ΔA=A3−A2), and Pmax the maximum value of the in-container pressure Pc in one period.

In the case where the force F3 exerted by the second gas 90 on the second partitioning plate 87 is smaller than or substantially equal to the maximum value Fmax of the force exerted by the in-container pressure Pc on the second partitioning plate 87, then the periodic change in the in-container pressure Pc moves the first and second partitioning plates 86, 87 and thereby greatly changes the in-container pressure Pc. As a result, the self-vibration of the working liquid 12 is hampered.

In view of this, according to this embodiment, the pressure P3 exerted on the partitioning plate 87 by the second gas 90, the sectional area A3 of the third space 94 and the sectional area A2 of the second space 93 are set in such a manner that the force F3 exerted by the second gas 90 on the second partitioning plate 87 is larger than the maximum value Fmax of the force exerted by the in-container pressure Pc on the second partitioning plate 87 (F3>Fmax).

In this way, the periodic change in the in-container pressure Pc is prevented from moving the first and second partitioning plates 86, 87 and thus hampering the self-vibration of the working liquid 12.

According to this embodiment, the reduction in the performance (output and efficiency) of the external combustion engine 10 which otherwise might be caused by the volume change of the working liquid 12 is prevented without using the control unit 21 and the various sensors, and therefore the structure of the external combustion engine 10 can be simplified to reduce the cost.

According to this embodiment, the second gas 90 is sealed in the third space 94. Alternatively, a similar elastic member to the elastic member 74 (FIG. 28) of the 14th embodiment may be disposed in the third space 94, which elastic member is compressed by the second partitioning plate 87 by the thermal expansion of the first gas 89 in the second space 93.

21st Embodiment

In the 20th embodiment described above, the reduction in the performance (output and efficiency) of the external combustion engine 10 which otherwise might be caused by the volume change of the working liquid 12 is prevented by regulating the volume of the container 11 depending on the temperature change of the working liquid 12. According to the 21st embodiment, on the other hand, the reduction in the performance (output and efficiency) of the external combustion engine 10 which otherwise might be caused by the volume change of the working liquid 12 is prevented by suppressing the volume change of the working liquid 12.

Figure 37:
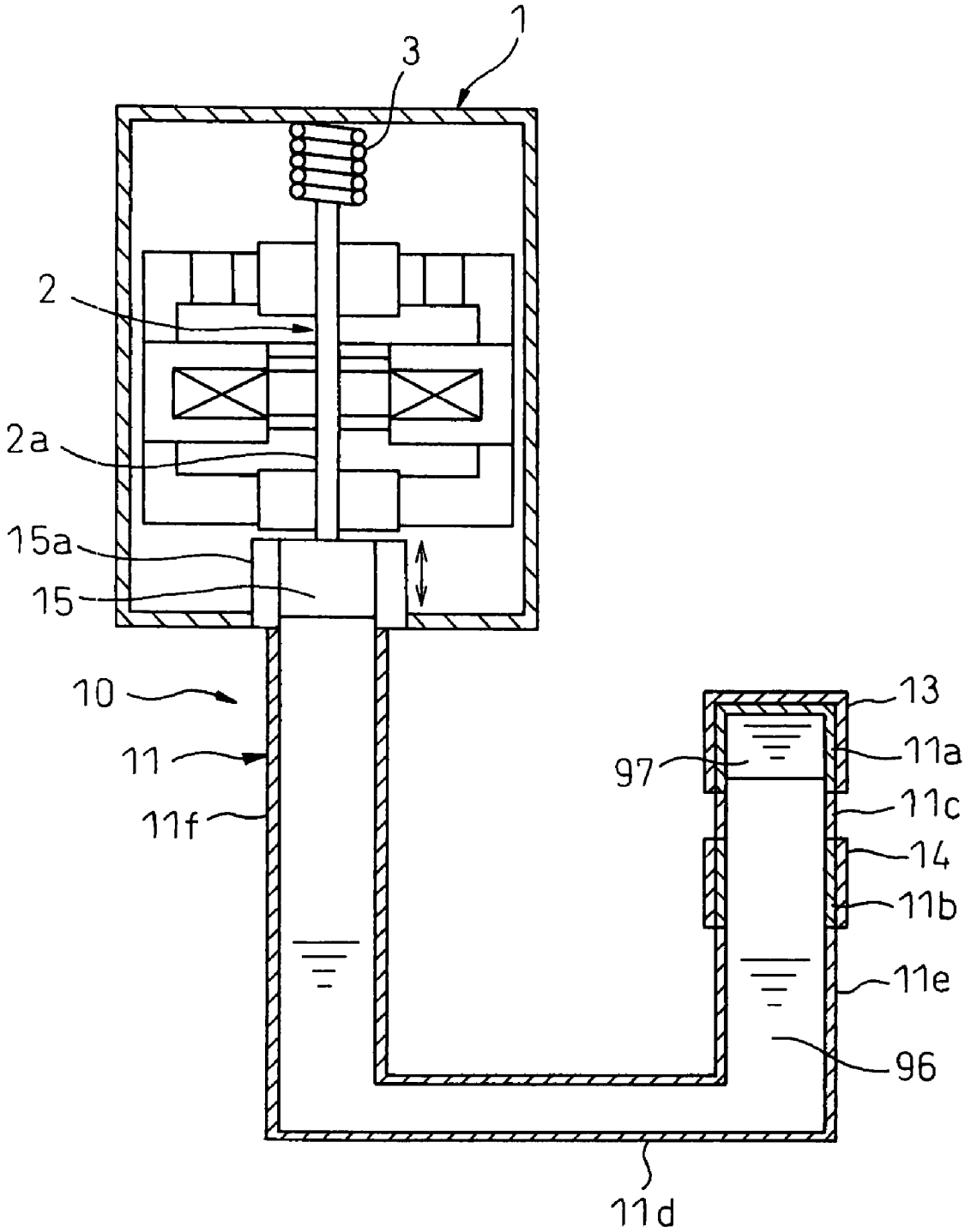
FIG. 37 is a diagram showing a general configuration of a power generating system according to a 21st embodiment of the invention.

FIG. 37 is a diagram showing a general configuration of the power generating system according to this embodiment. As compared with the 19th embodiment described above, the container volume regulating space 82, the first and second partitioning plates 86, 87 making up the volume regulating mechanism 85, the connecting unit 88, the first and second gases 89, 90 and the heat conducting portion 91 are eliminated.

According to this embodiment, on the other hand, a first working liquid 96 and a second working liquid 97 smaller in the coefficient of linear expansion than the first working liquid 96 and insoluble in the first working liquid 96 are sealed in a state adapted to flow in the first container 11. In this example, water is used as the first working liquid 96, and mercury as the second working liquid 97.

More specifically, the second working liquid 97, in about the same volume as the heated portion 11*a*, is sealed in the heated portion 11*a* of the container 11, while the first working liquid 96 is sealed in other than the heated portion 11*a* of the container 11.

According to this embodiment, water is used as the first working liquid 96. Also, according to this embodiment, the heated portion 11*a* is disposed at the upper end of the first linear portion 11*e* and, therefore, a liquid smaller in specific gravity than the first working liquid 96 is used as the second working liquid 97.

Figure 38:
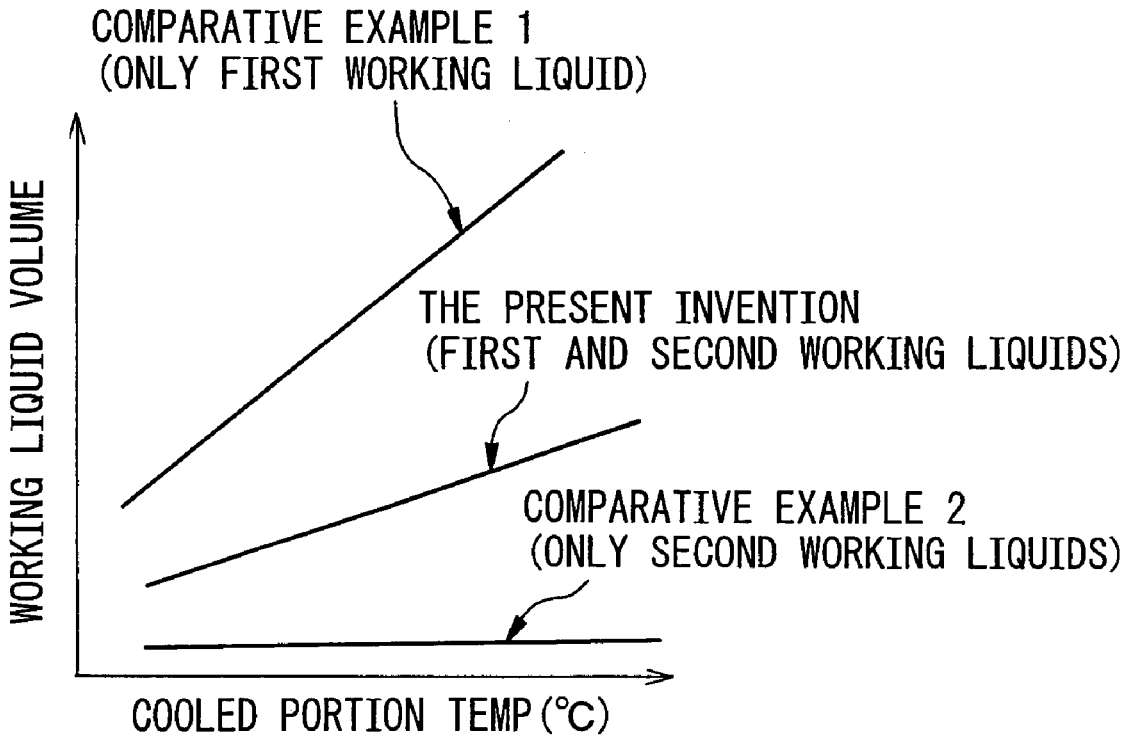
FIG. 38 is a graph showing the relation, as compared with the comparative examples 1 and 2, between the temperature of the cooled portion and the volume of the working liquid according to the 21st embodiment.

FIG. 38 is a graph showing the relation between the cooled-portion temperature T2 and the volume of the working liquid, as compared between this embodiment and first and second comparative examples. In this graph, the first comparative example represents a case in which the working liquid includes only the first working liquid 96, and the second comparative example a case in which the working liquid includes only the second working liquid 97.

As shown in FIG. 38, according to this embodiment, the volume change of the working liquid which otherwise might be caused by the change in the cooled-portion temperature T2 can be suppressed more than in the first comparative example by sealing the second working liquid 97, different from the first working liquid 96, in the heated portion 11*a*.

As a result, the volume change of the working liquid 12 which otherwise might be caused by the temperature change of the working liquid 12 can be suppressed, and therefore the reduction in the performance (output and efficiency) of the external combustion engine 10 which otherwise might be caused by the volume change of the working liquid 12 is prevented.

According to this embodiment, unlike in the 20th embodiment, the volume regulating mechanism 85 is not required. Therefore, the structure of the external combustion engine 10 can be further simplified for a further cost reduction.

In the case where the working liquid includes only the second working liquid 97 as in the second comparative example, the volume change of the fluid in the container 11 which otherwise might be caused by the change in the cooled-portion temperature T2 can be suppressed more, and therefore the reduction in the performance (output and efficiency) of the external combustion engine 10 which otherwise might be caused by the volume change of the working liquid 12 is prevented.

Other Embodiments

The embodiments described above represent a case in which the invention is used as a drive source of a power generating system. The external combustion engine according to this invention, however, can be used also as a drive source of other than the power generating system.

While the invention has been described by reference to specific embodiments chosen for purposes of illustration, it should be apparent that numerous modifications could be made thereto by those skilled in the art without departing from the basic concept and scope of the invention.

The invention claimed is:

1. An external combustion engine comprising:

a container sealed with a working liquid in a way adapted to flow therein;

a heater for heating and vaporizing the working liquid in the container; and a cooler for cooling and liquefying the vapor of the working liquid heated and vaporized by the heater;

wherein the displacement of the working liquid caused by the volume change of the vapor is output by being converted into the mechanical energy, the external combustion engine further comprising:

a pressure regulating container sealed with a pressure regulating liquid and communicating with the container;

a heating means for heating and vaporizing the pressure regulating liquid; and a restrictor means disposed in the communicating portion between the pressure regulating container and the container;

wherein the pressure regulating container and the heating means are adapted to maintain at least a part of the pressure regulating liquid in a boiling state; and wherein the pressure regulating container is adapted to have such a thermal resistance that the temperature (Th) of the high-temperature portion of the pressure regulating container for vaporizing the pressure regulating liquid assumes a value intermediate between the temperature (T1) of the heated portion of the container for vaporizing the working liquid and the temperature (T2) of the cooled portion of the container for liquefying the vapor of the working liquid.

2. The external combustion engine according to claim 1, wherein the heat source of the heating means is a high-temperature gas.

3. The external combustion engine according to claim 2, wherein the high-temperature gas is used also a heat source of the heated portion of the container for vaporizing the working liquid.

4. The external combustion engine according to claim 3, wherein the heating means is located downstream of the heated portion in the high-temperature gas flow.

5. The external combustion engine according to claim 1, further comprising a heat conduction means for conducting the heat of the heated portion to the heating means.

6. The external combustion engine according to claim 1, wherein the pressure regulating liquid is the same liquid as the working liquid.

* * * * *